US008460757B2

(12) United States Patent
Tian

(10) Patent No.: US 8,460,757 B2
(45) Date of Patent: Jun. 11, 2013

(54) VARIABLE TEXTURE FLOOR COVERING

(75) Inventor: Dong Tian, Lancaster, PA (US)

(73) Assignee: Armstrong World Industries, Inc., Lancaster, PA (US)

( * ) Notice: Subject to any disclaimer, the term of this patent is extended or adjusted under 35 U.S.C. 154(b) by 0 days.

(21) Appl. No.: 12/455,518

(22) Filed: Jun. 3, 2009

(65) Prior Publication Data

US 2009/0238980 A1 Sep. 24, 2009

Related U.S. Application Data

(62) Division of application No. 11/497,768, filed on Aug. 2, 2006.

(60) Provisional application No. 60/704,536, filed on Aug. 2, 2005.

(51) Int. Cl.
*B05D 3/12* (2006.01)

(52) U.S. Cl.
USPC ..... 427/370; 427/271; 427/277; 427/369; 427/508

(58) Field of Classification Search
USPC ..... 427/508, 271, 277, 369, 370
See application file for complete search history.

(56) References Cited

U.S. PATENT DOCUMENTS 4,547,245 A * 10/1985 Colyer ..... 156/220
5,112,671 A 5/1992 Diamond et al.
6,228,463 B1 5/2001 Chen et al.
6,333,076 B1 12/2001 Sigel et al.
6,572,932 B2 6/2003 Sigel et al.
6,730,388 B2 5/2004 MacQueen et al.
2004/0219334 A1 11/2004 Watts et al.
2005/0129911 A1* 6/2005 Royse ..... 428/141

FOREIGN PATENT DOCUMENTS

WO WO03/057458 A2 7/2003

* cited by examiner

*Primary Examiner* — Robert S Walters, Jr.
(74) *Attorney, Agent, or Firm* — McNees Wallace & Nurick LLC

(57) ABSTRACT

A floor covering has an exposed surface with substantially the same gloss level and at least two portions having different tactile surface characteristics. The difference in the tactile surface characteristics between the two portions is at least an average RPc of 4. The floor covering includes a substrate and a high performance coating overlying the substrate. The high performance coating comprises texture particles, which may be organic polymer particles. The floor covering is made by forming a high performance coating including the texture particles on a substrate, at least partially curing the high performance coating, and then while controlling the temperature of the high performance coating below the melting point temperature or softening point temperature of the texture particles and above the temperature at which the texture particles deform under the applied mechanical embossing pressure, subjecting the first and second portions to different mechanical embossing conditions.

12 Claims, 34 Drawing Sheets

VTx® – Variable Texture

FIG 23
VTx® - Process Flow Chart
Method 1 – when use thermal cure coating as high performance top coating
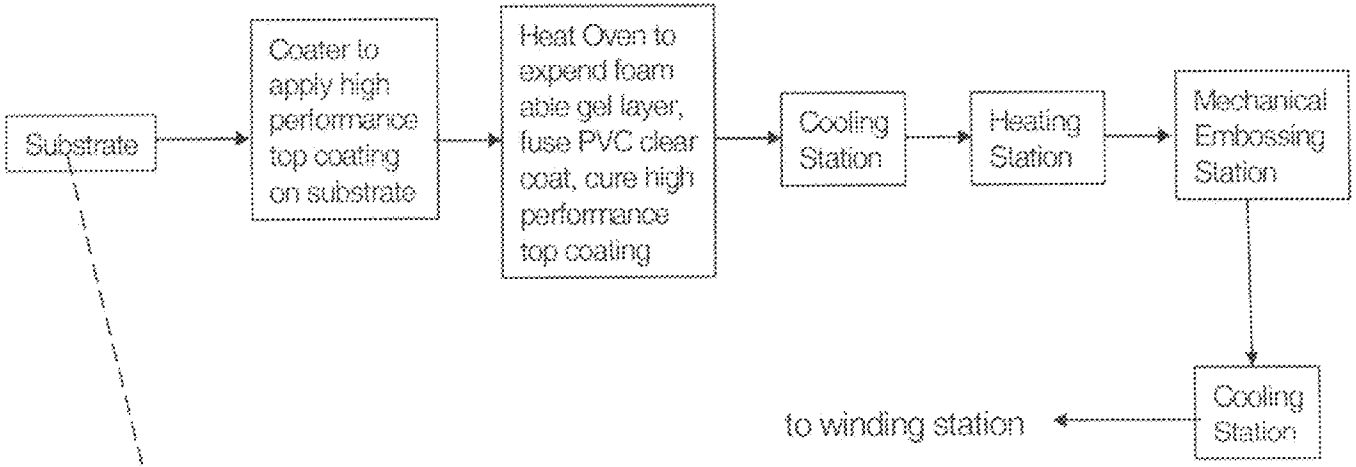
Substrate Structure:
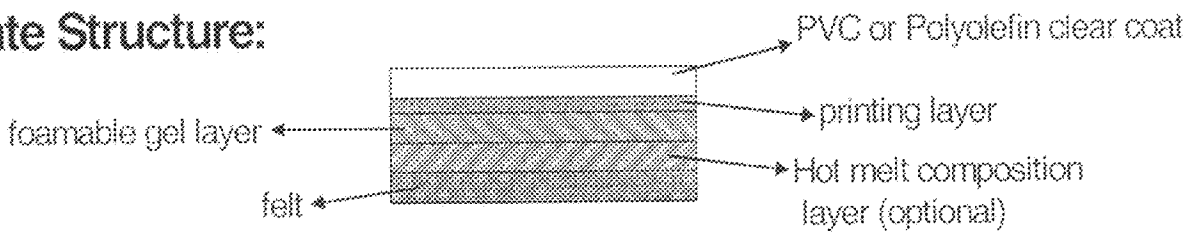

VTx® - Process Flow Chart

Method 2 – when use thermal/UV dual cure coating or waterborne UV coating as high performance top coating

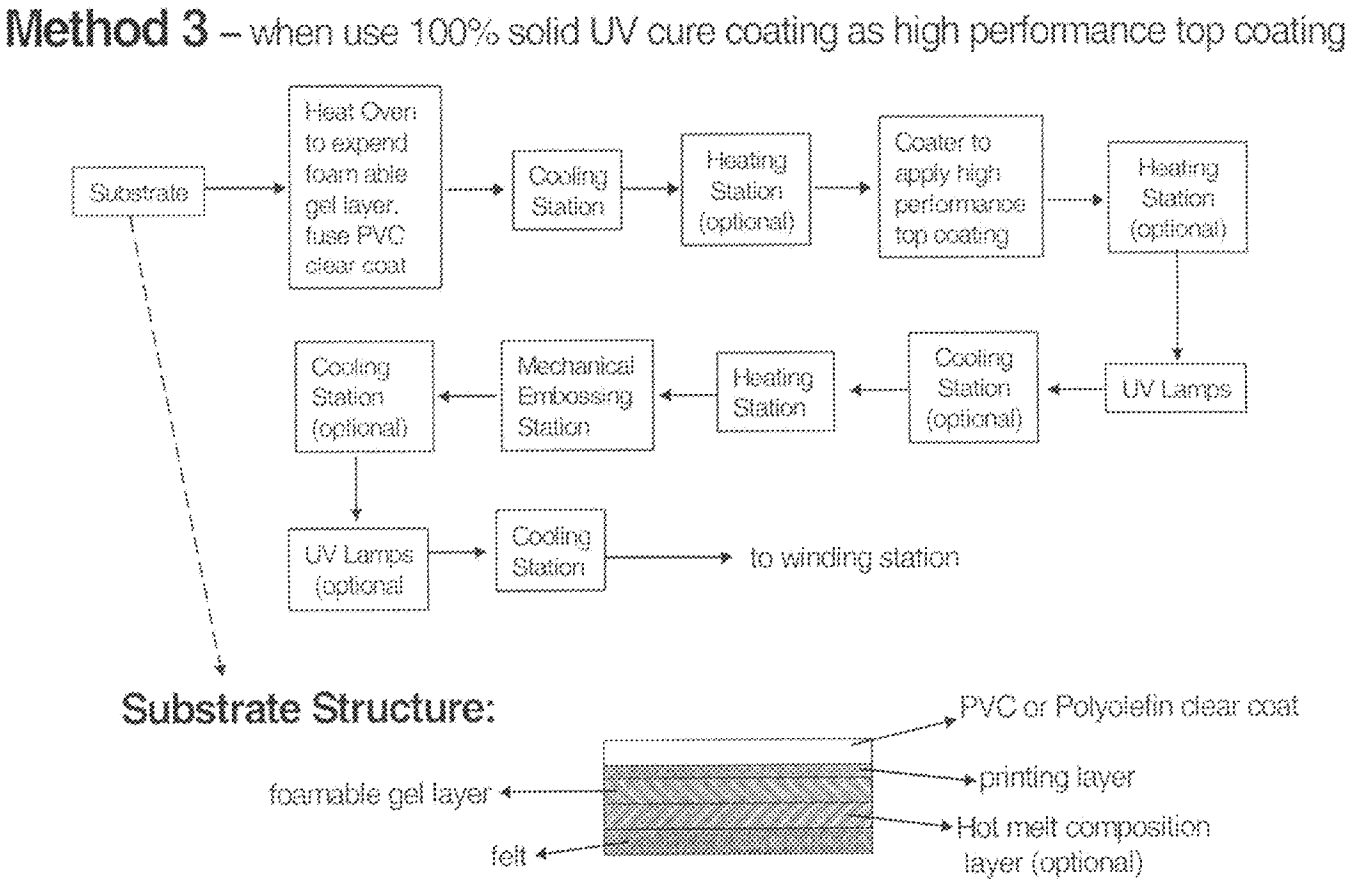
FIG 25
VTx® - Process Flow Chart
Method 3 – when use 100% solid UV cure coating as high performance top coating
Substrate
Heat Oven to expand foam able gel layer. Use PVC clear coat
Cooling Station
Heating Station (optional)
Coater to apply high performance top coating
Heating Station (optional)
UV Lamps
Cooling Station (optional)
Heating Station
Mechanical Embossing Station
Cooling Station (optional)
UV Lamps (optional)
Cooling Station
to winding station
Substrate Structure:
PVC or Polyolefin clear coat
printing layer
Hot melt composition layer (optional)
foamable gel layer
felt VTx® - Process Flow Chart Method 4 – when use 100% solid UV cure coatings as high performance top coating VTx® - Process Flow Chart Method 5 – when use thermal cure coating as high performance top coating

VTx® - Process Flow Chart

Method 6 – when use thermal/UV dual cure coating or waterborne UV coating as high performance top coating VTx® - Process Flow Chart Method 7 – when use 100% solid UV cure coating as high performance top coating

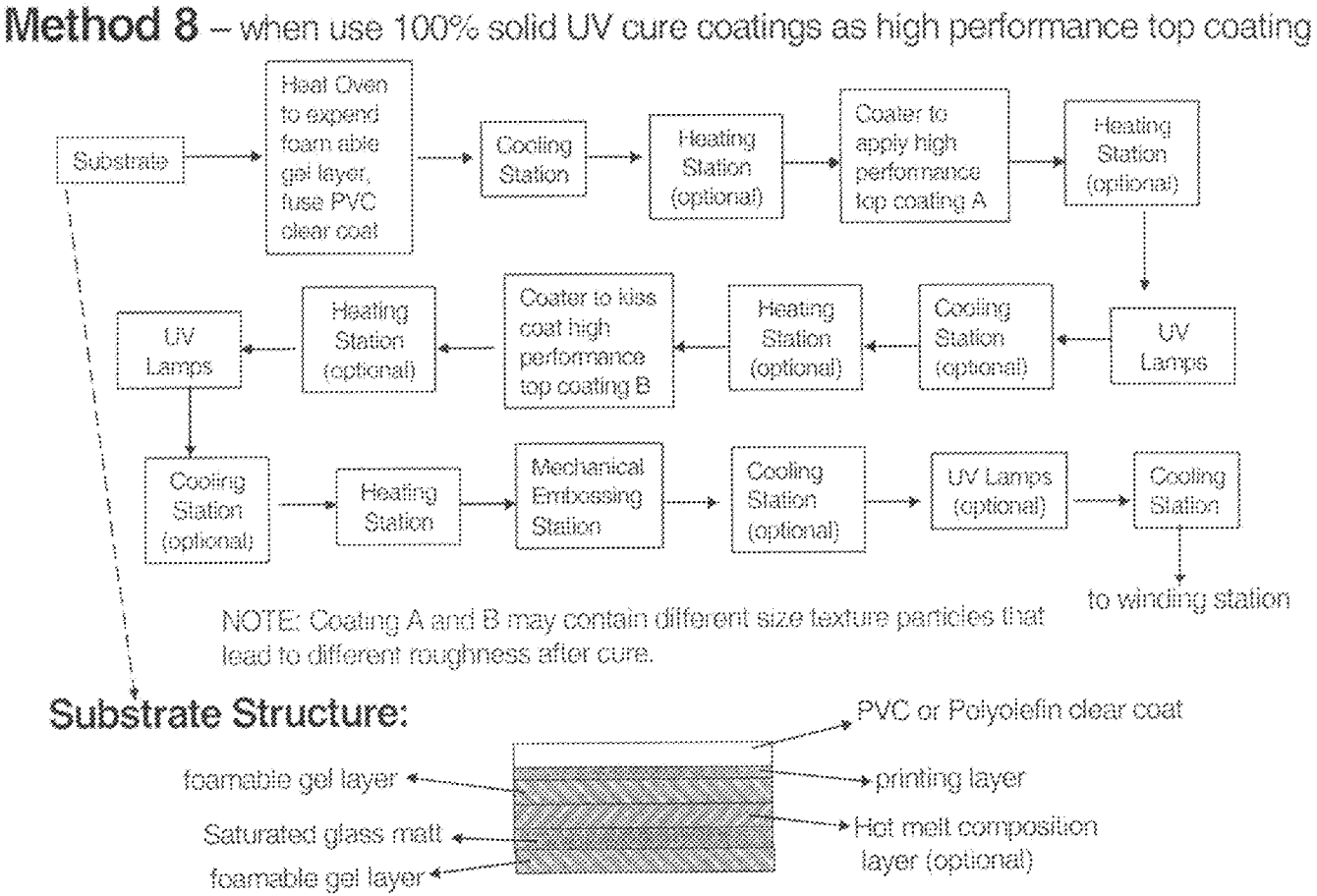
FIG 30
VTx® - Process Flow Chart
Method 8 – when use 100% solid UV cure coatings as high performance top coating
Substrate
Heat Oven to expand foam able gel layer, fuse PVC clear coat
Cooling Station
Heating Station (optional)
Coater to apply high performance top coating A
Heating Station (optional)
UV Lamps
Cooling Station (optional)
Heating Station (optional)
Coater to kiss coat high performance top coating B
Heating Station (optional)
UV Lamps
Cooling Station (optional)
Heating Station
Mechanical Embossing Station
Cooling Station (optional)
UV Lamps (optional)
Cooling Station
to winding station
NOTE: Coating A and B may contain different size texture particles that lead to different roughness after cure.
Substrate Structure:
foamable gel layer
Saturated glass matt
foamable gel layer
PVC or Polyolefin clear coat
printing layer
Hot melt composition layer (optional)

VTx® - Process Flow Chart

Method 9 – when use thermal cure coating as high performance top coating

VTx® - Process Flow Chart

Method 10 – when use thermal/UV dual cure coating or waterborne UV coating as high performance top coating VTx® - Process Flow Chart Method 11 – when use 100% solid UV cure coating as high performance top coating

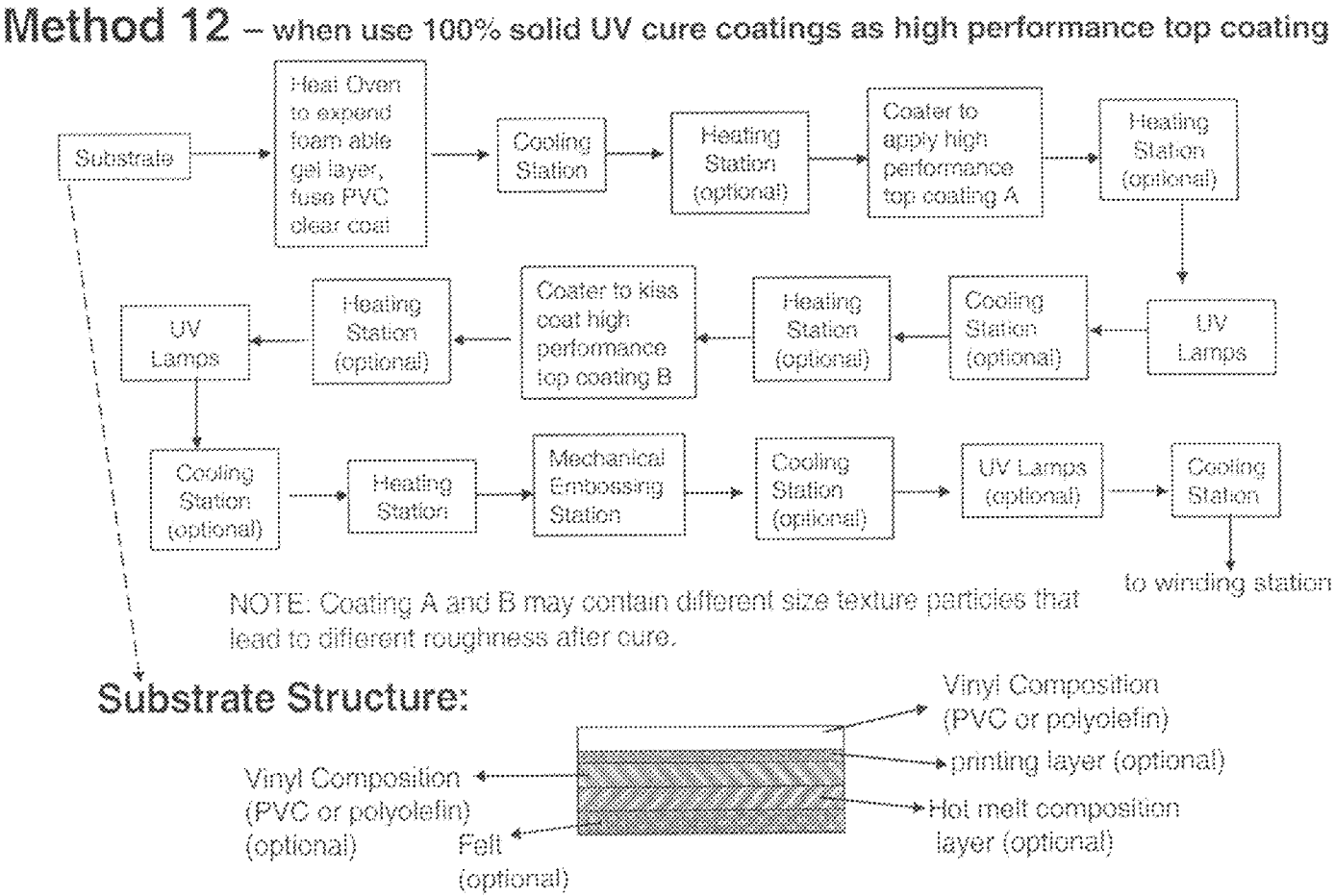
FIG 34
VTx® - Process Flow Chart
Method 12 – when use 100% solid UV cure coatings as high performance top coating
Substrate
Heat Oven to expand foam able gel layer, fuse PVC clear coat
Cooling Station
Heating Station (optional)
Coater to apply high performance top coating A
Heating Station (optional)
UV Lamps
Cooling Station (optional)
Heating Station (optional)
Coater to kiss coat high performance top coating B
Heating Station (optional)
UV Lamps
Cooling Station (optional)
Heating Station
Mechanical Embossing Station
Cooling Station (optional)
UV Lamps (optional)
Cooling Station
to winding station
NOTE: Coating A and B may contain different size texture particles that lead to different roughness after cure.
Substrate Structure:
Vinyl Composition (PVC or polyolefin) (optional)
Felt (optional)
Vinyl Composition (PVC or polyolefin)
printing layer (optional)
Hot melt composition layer (optional)

VTx® - Process Flow Chart

Method 13 -- when use 100% solid UV coating and or water-based UV coating as high performance top coating

VARIABLE TEXTURE FLOOR COVERING

CROSS-REFERENCE TO RELATED APPLICATIONS

This application is a divisional of U.S. patent application Ser. No. 11/497,768, filed Aug. 2, 2006 that claims priority from U.S. Patent Application Ser. No. 60/704,536, filed Aug. 2, 2005.

The present invention relates to a floor covering having an exposed surface with substantially the same gloss level and at least two portions having different tactile surface characteristics, and the method of making it. The floor covering is made by forming a high performance coating including texture particles on a substrate, at least partially curing the high performance coating, and then while controlling the temperature of the high performance coating below the melting point temperature or softening point temperature of the texture particles and above the temperature at which the texture particles deform under the applied mechanical embossing pressure, subjecting the first and second portions to different mechanical embossing conditions. Preferably, the temperature of the high performance coating during the mechanical embossing is between approximately 10° F. and 400° F. below the melting point temperature or softening point temperature of low melting point texture particles and between approximately 250° F. and 450° F. below the melting point temperature or softening point temperature of high melting point texture particles

BACKGROUND OF THE INVENTION

Texture is a tactile surface characteristic which is synonymous with roughness. It can be felt by moving a finger over a surface with light pressure and can be quantified by average peak density (RPc). Average RPc is the average of a number, such as 30, PRc values as can be measured by a surface texture meter of profilometer, such as a Surfak-SV/Pro/SJ surface texture meter or profilometer sold by Mitutoyo. The higher the average peak density, the rougher the surface texture.

As used herein, "substantially the same gloss level" means a difference in 60° gloss level of 5.0 or less. The 60° gloss level of known prior art floor products having different areas of roughness vary by at least 5.5. With regard to the present examples, gloss level was measured with a BYK gloss meter.

As used herein, a "high performance coating" means (a) a water-based thermal curable coating comprising a resin such as waterborne epoxy, polyurethane aqueous dispersion, or polyvinyl chloride aqueous dispersion, a crosslinker such as urea formaldehyde or melamine formaldehyde, one or more catalysts and one or more surfactants, (b) a water-based radiation curable coating comprising a resin such as acrylic emulsion, polyurethane aqueous dispersion, acrylated polyether, acrylated polyester or acrylated urethane, one or more surfactants and at least one photoinitiator, (c) a 100% solids thermal curable coating comprising a resin such as polyester polyol, polyether polyol or urethane, a crosslinker such as urea formaldehyde or melamine formaldehyde, at least one thermal catalyst, one or more surfactants, (d) a 100% solids thermal curable coating comprising a resin such as acrylated polyether, acrylated polyester or acrylated urethane, at least one thermal initiator and at least one surfactant, (e) 100% solids radiation curable coating comprising a resin such as acrylated polyether, acrylated polyester or acrylate urethane, at least one surfactant and at least one photoinitiator, (f) a 100% solids thermal/radiation dual cure coating comprising at least one of the resins listed in (e) above, at least one of the resins listed in (c) and (d) above, a crosslinker such as urea formaldehyde or melamine formaldehyde, at least one photoinitiator, at least one thermal catalyst and one or more surfactants, or (g) a water-based thermal/radiation dual cure coating comprising at least one of the resins listed in (a) above, at least one of the resins listed in (b) above, a crosslinker such as urea formaldehyde or melamine formaldehyde, at least one photoinitiator, one or more catalysts and one or more surfactants. Each of the above-identified high performance coatings can include additives known in the art, including flatting agents, pigments, coalescing solvents and defoamers.

SUMMARY OF THE INVENTION

The floor covering of the present invention has an exposed surface with substantially the same gloss level and at least two portions having different tactile surface characteristics, and the method of making it. The difference in the tactile surface characteristics between the two portions is at least an average RPc of 4. The floor covering includes a substrate and a high performance coating overlying the substrate. The high performance coating comprises texture particles, which may be organic polymer particles, such as nylon particles, man-made wax particles, natural wax particles, polyolefin particles, Teflon particles, polyetheretherketone (PEEK) particles, ethylene and chlorotrifluoroethylene copolymer particles, polyester particles, urea-formaldehyde polymer particles, polyacrylate particles, polycarbonate particles, polyvinylchloride particles, polyimide particles, or combinations thereof.

Teflon particles and PEEK particles have high melting points, greater than 575° F. The other listed examples of texture particles have low melting points no greater than 575° F. The operating temperature used to produce the floor coverings depends on the materials forming the floor substrate, as well as the melting point or softening point of the texture particles. Therefore, the temperature of the high performance coating is controlled below the melting point temperature or softening point temperature of the texture particles and above the temperature at which the texture particles deform under the applied mechanical embossing pressure, preferably between approximately 10° F. and 400° F. below the melting point temperature or softening point temperature of low melting point or softening point texture particles and between approximately 250° F. and 450° F. below the melting point temperature or softening point temperature of high melting point or softening point texture particles. These temperatures permit deforming of the texture particles under the desired mechanical embossing conditions while not damaging the floor covering substrate.

The flooring coverings with variable texture may have any desired gloss level, for example a 60° gloss level from about 2 to about 60 or above 60. The invention specifically includes ultra low gloss floor coverings having a 60° gloss level from about 2 to about 16, and more preferably from about 6 to about 11.

The floor covering has substantially the same gloss level, i.e. the difference in 60° gloss level across the floor covering is no greater than 5.0 as measured with a BYK gloss meter. Preferably the difference in 60° gloss level across the floor covering of the present invention is less than 3 and more preferably less than 1.

The floor covering is made by forming a high performance coating including the texture particles on a substrate, at least partially curing the high performance coating, and then while controlling the temperature of the high performance coating below the melting point temperature or softening point temperature of the texture particles and above the temperature at which the texture particles deform under the applied mechanical embossing pressure, preferably between approximately 10° F. and 400° F. below the melting point temperature or softening point temperature of low melting point or softening point texture particles and between approximately 250° F. and 450° F. below the melting point temperature or softening point temperature of high melting point or softening point texture particles, subjecting the first and second portions to different mechanical embossing conditions. The different conditions include different average pressures, different embossing temperatures, and different average pressures and embossing temperatures. The difference in average pressures can be obtained by overall mechanical embossing of a chemically embossed substrate or using different mechanical embossing profiles, for example.

BRIEF DESCRIPTION OF THE DRAWINGS

FIGS. 23 to 35 are process flow charts showing examples of various methods and substrates of the present invention.

DETAILED DESCRIPTION OF THE INVENTION

Figure 1:
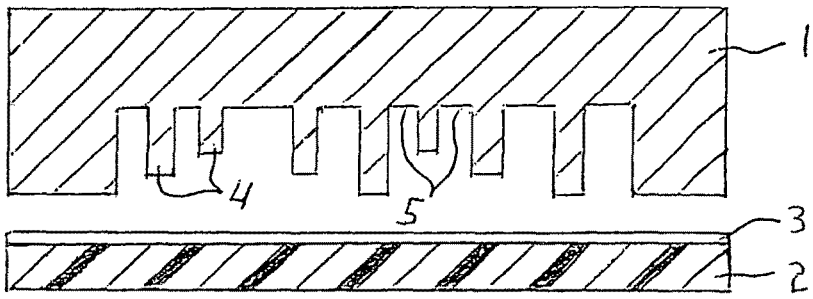
FIG. 1 is a schematic drawing of a mechanical embossing tool overlying a substrate coated with a high performance coating.

The floor covering of the present invention has an exposed surface with two portions having different tactile surface characteristics, but substantially the same gloss level. The difference in the tactile surface characteristics between the first and second portions is at least an average RPc of 4.

In one embodiment, the floor covering has a 60° gloss level across the floor covering of no greater than about 5. This yields a floor covering having a similar look due to the gloss, but with a different feel. To improve this effect, it is preferred that the 60° gloss level across the floor covering be no greater than about 3 or more preferably no greater than about 1.

To be able to feel the difference in the tactile surface characteristic between the first portion and the second portion, the difference in average RPc must be at least 4. To more easily feel the difference, the difference in average RPc should be at least 10. To be appealing to the consumer, the difference in the tactile surface characteristics between the first and second portions should have an average RPc of less than 75.

Typically, the floor covering comprises at least a substrate and a high performance coating overlying the substrate. The substrate may include a PVC clear coat, a polyolefin clear coat, a vinyl composition layer, a print layer, a foamable layer, a hot melt composition layer, a felt, a glass mat, laminate, wood or combinations thereof. The substrate is not critical to the invention and includes any known flooring substrate including a PVC clear coat, a polyolefin clear coat, a vinyl composition layer, a print layer, a foamable layer, a hot melt composition layer, a felt, a glass mat or combinations thereof. For the purposes of this invention, the substrate is all the layers below the high performance coating.

The high performance coating includes texture particles which are large enough to produce a textured surface when the high performance coating is applied to a substrate. The texture particles comprise an organic polymer, including nylon, man-made wax, natural wax, polyolefin, Teflon, PEEK (Polyetheretherketone), ECTFE (ethylene and chlorotrifluoroethylene copolymer), polyester particles, urea-formaldehyde polymer particles, polyacrylate particles, polycarbonate particles, polyvinylchloride particles, polyimide particles, or any other material which will soften at the mechanical embossing conditions (temperature and pressure) of the process.

It is critical for the temperature of the exposed surface of the high performance coating to be below the melting point temperature or softening point temperature of the texture particles and above the temperature at which the texture particles deform under the applied mechanical embossing pressure. This is typically between approximately 10° F. and 400° F. below the melting point temperature or softening point temperature of low melting point or softening point texture particles and between approximately 250° F. and 450° F. below the melting point temperature or softening point temperature of high melting point or softening point texture particles, as the high performance coating is mechanically embossed. This permits the texture particles to be reshaped creating the difference in the tactile surface characteristics.

Another critical parameter is the average pressure applied by the mechanical embossing tool on the texture particles of the high performance coating. The protrusions on the mechanical embossing tool are referred to as peaks and the down areas are referred to as valleys. The peaks typically have flat upper surfaces and resemble plateaus. When the embossing tool presses on the floor substrate, there will be different pressures created by the tool on the substrate surface due to the peak areas and valley areas on the tool. The peak areas on the tool will create high pressure on the substrate. This will smooth out the texture/roughness created by the texture particles in the high performance top coating.

Clearly, the valley areas on the mechanical embossing tool will create less pressure on the texture particles in the high performance top coating. This difference in average pressure is one method to get variable texture from the same textured top coating formula. See FIG. 1, in which the cross-section of the embossing tool 1 is positioned over the floor substrate 2, the floor substrate being coated with a high performance coating 3. The peak areas 4 will apply a greater average pressure on the texture particles in the high performance coating than the valley areas 5.

Typically, the mechanical embossing tool is an overall mechanical embossing tool, which applies the same pattern over the entire width of the high performance coated floor covering substrate. The temperature of the mechanical embossing tool is kept below 110° F. or a temperature necessary to set the mechanical embossing.

The difference in the first average pressure and second average pressure can result from the peaks on the mechanical embossing tool corresponding to the first area having greater height than the peaks corresponding to the second area. In another embodiment, the difference in the first average pressure and second average pressure can result from the peaks on the mechanical embossing tool having the same height, but the peaks corresponding to the first area having widths that are greater than the widths of the peaks corresponding to the second area.

Figure 2:
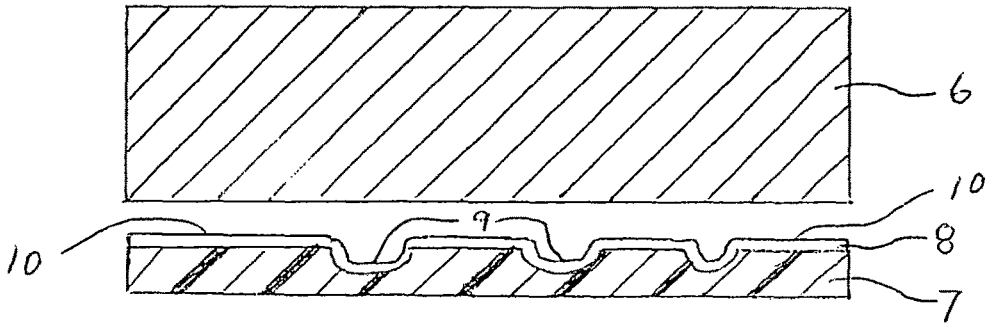
FIG. 2 is a schematic drawing of another mechanical embossing tool overlying a substrate coated with a high performance coating.

Any method that could cause pressure differences during the mechanical embossing of the texture coating surface will create the variable textures on the finished floor products. For example, as shown in FIG. 2, when using a flat embossing tool 6 on a chemically embossed substrate 7 and high performance coating 8, the chemically embossed valleys or down areas 9 will be rougher than the top raised surface 10 of the floor substrate because the embossing tool 7 creates higher pressure on the top surface area as the embossing tool smoothes out the texture particles. Of course, the combination of an embossing tool having peak areas and valley areas and a chemically embossed substrate will create more variable texture on the texture coating coated substrate.

The other parameters that affect the variable texture include substrate temperature and the melting point or softening point of the texture particles in the coating. The temperature difference between the melting point temperature or softening point temperature of the texture particles and the temperature of the high performance coating during the mechanical embossing process should be between approximately 10° F. and 400° F. for low melting point or softening point texture particles and between approximately 250° F. and 450° F. below the melting point temperature or softening point temperature for high melting point or softening point texture particles to ensure that the particles can be reshaped without melting or softening.

Figure 3B:
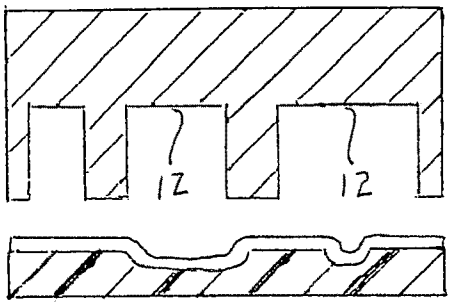
FIGS. 3A and 3B are schematic drawings of different mechanical embossing tools overlying chemically embossed substrates, each coated with a high performance coating.
Figure 3A:
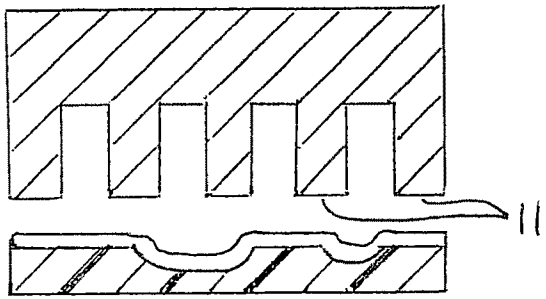
Figure 4:
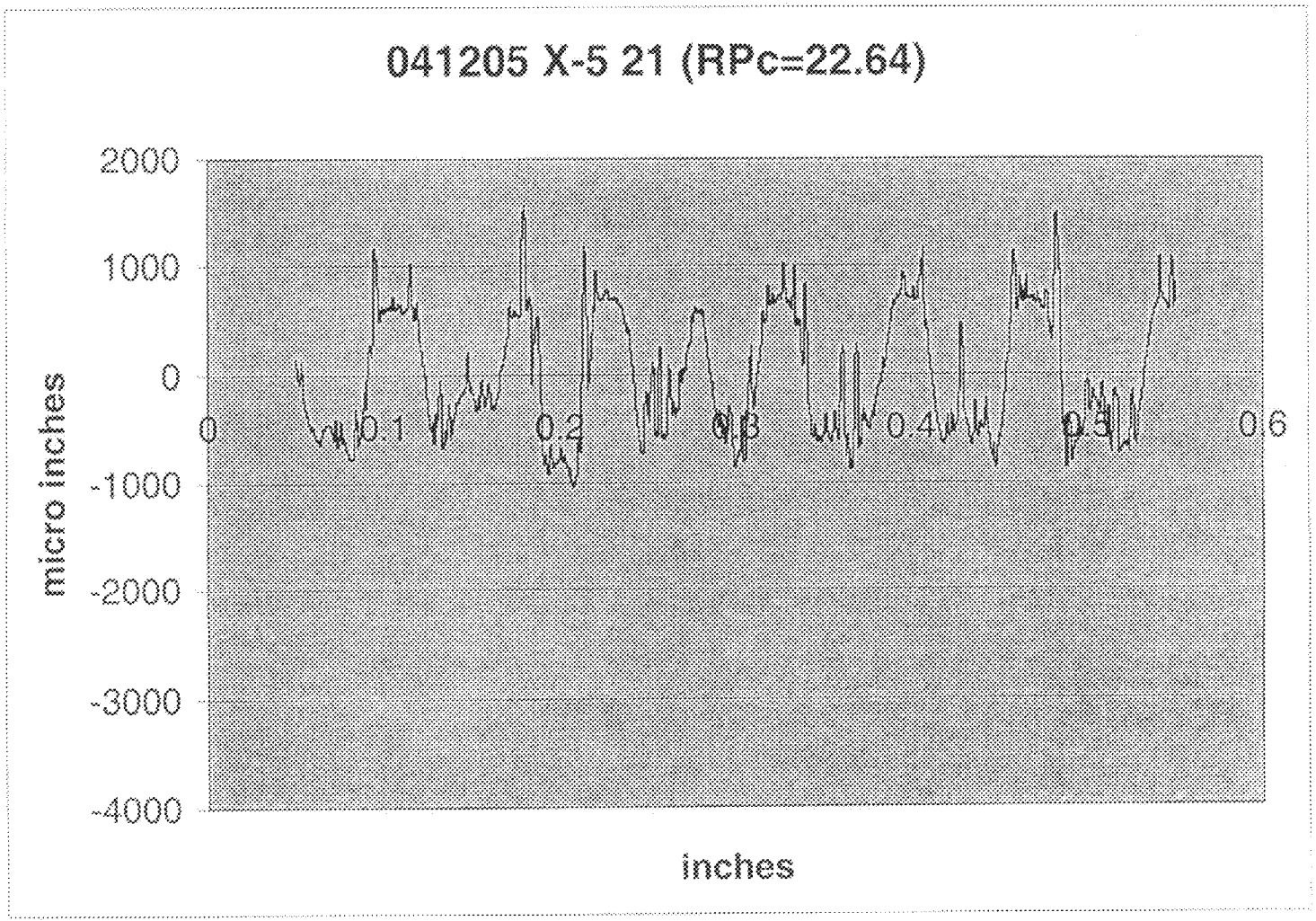
FIGS. 4 to 22 are graphs showing the surface profiles of the various samples as measured by the Mitutoyo Surface meter.
Figure 5:
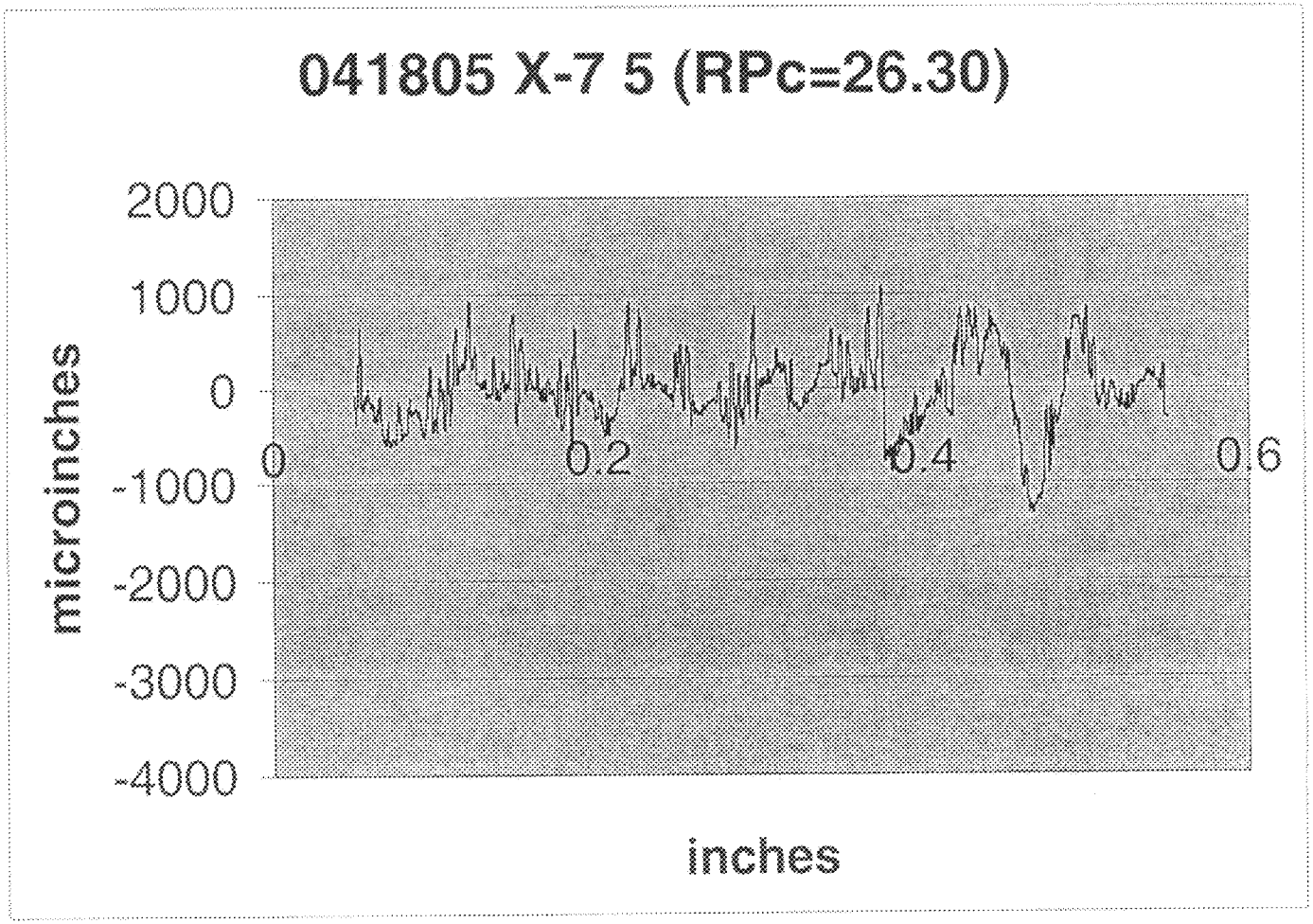
Figure 6:
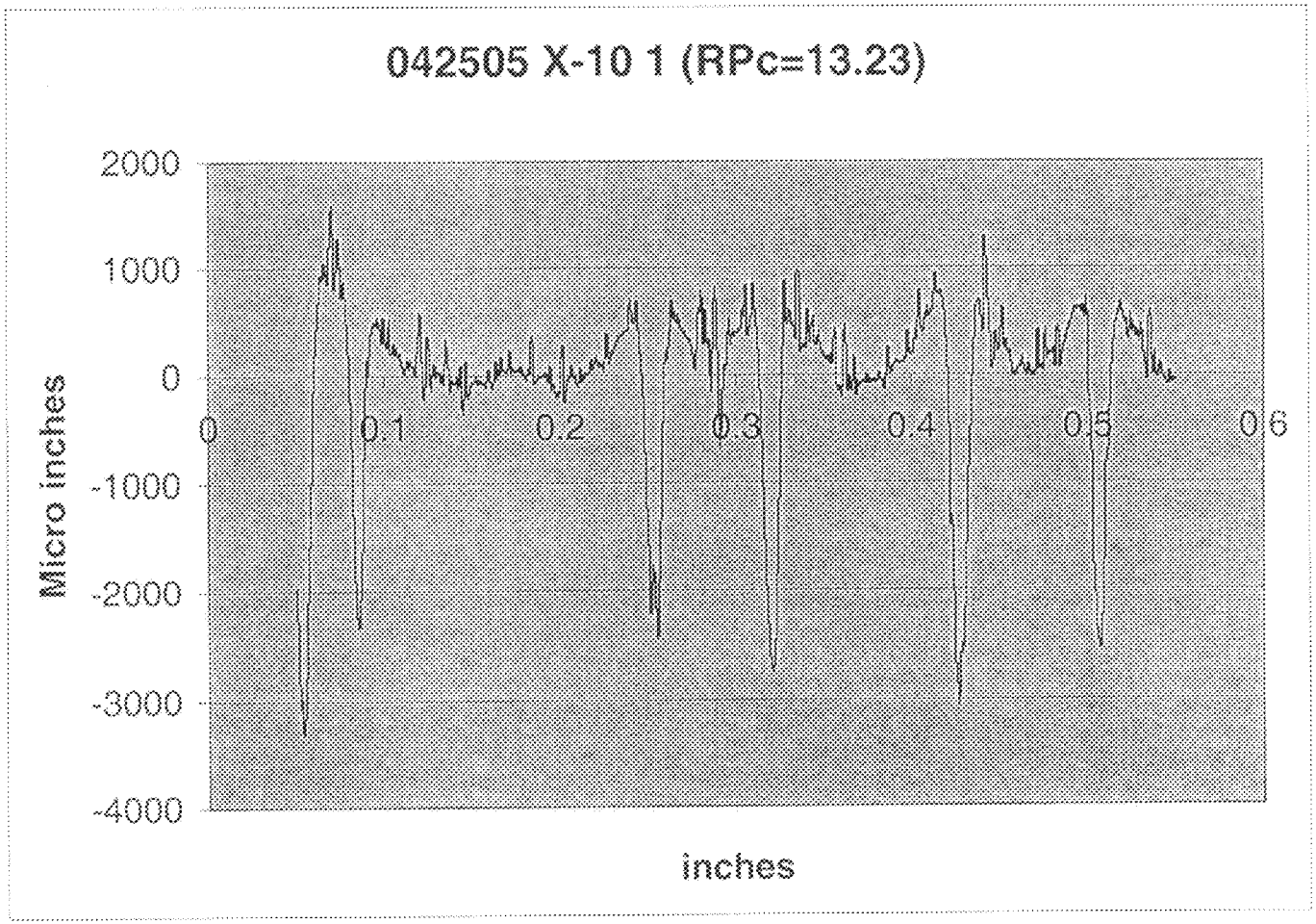
Figure 7:
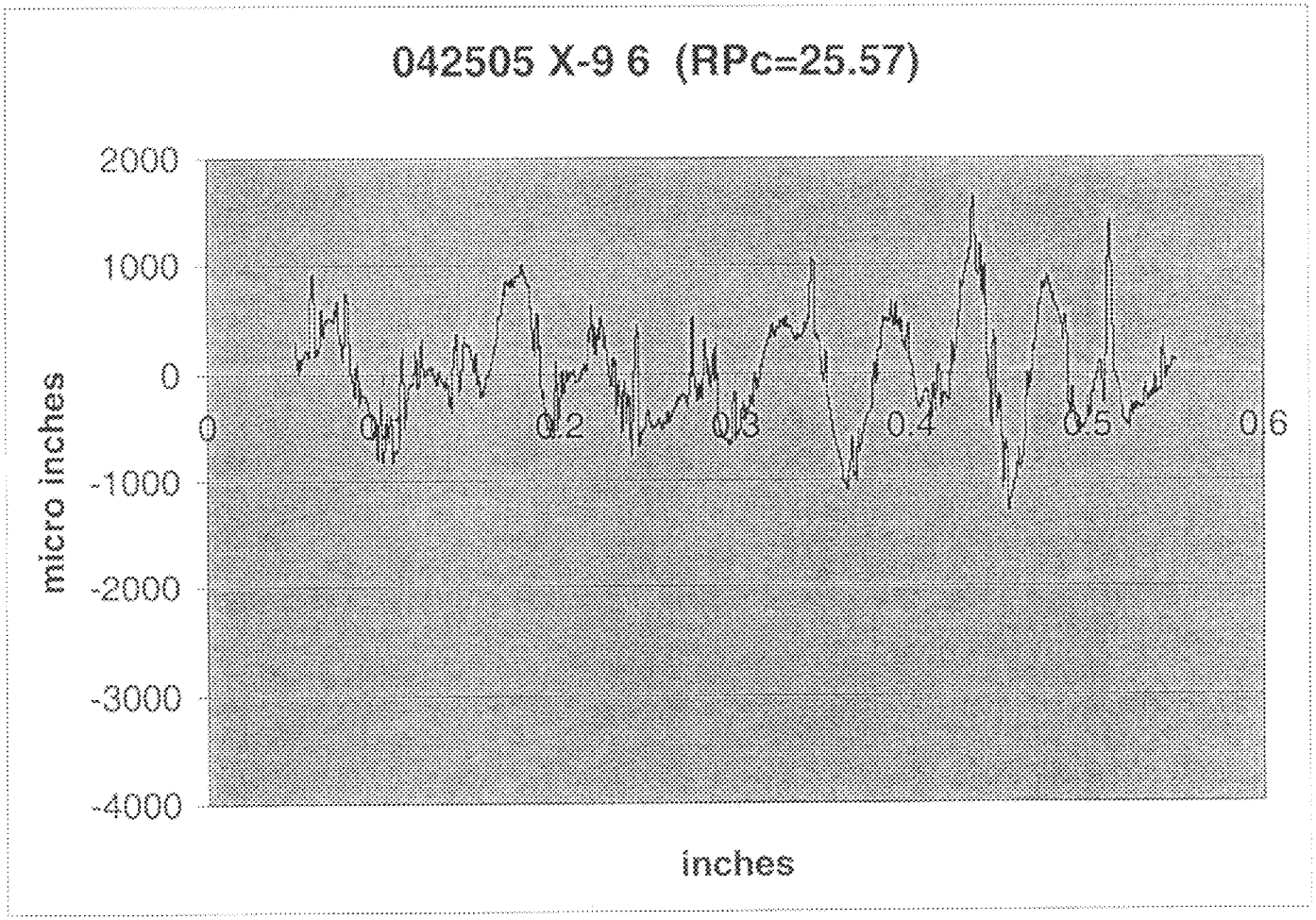
Figure 8:
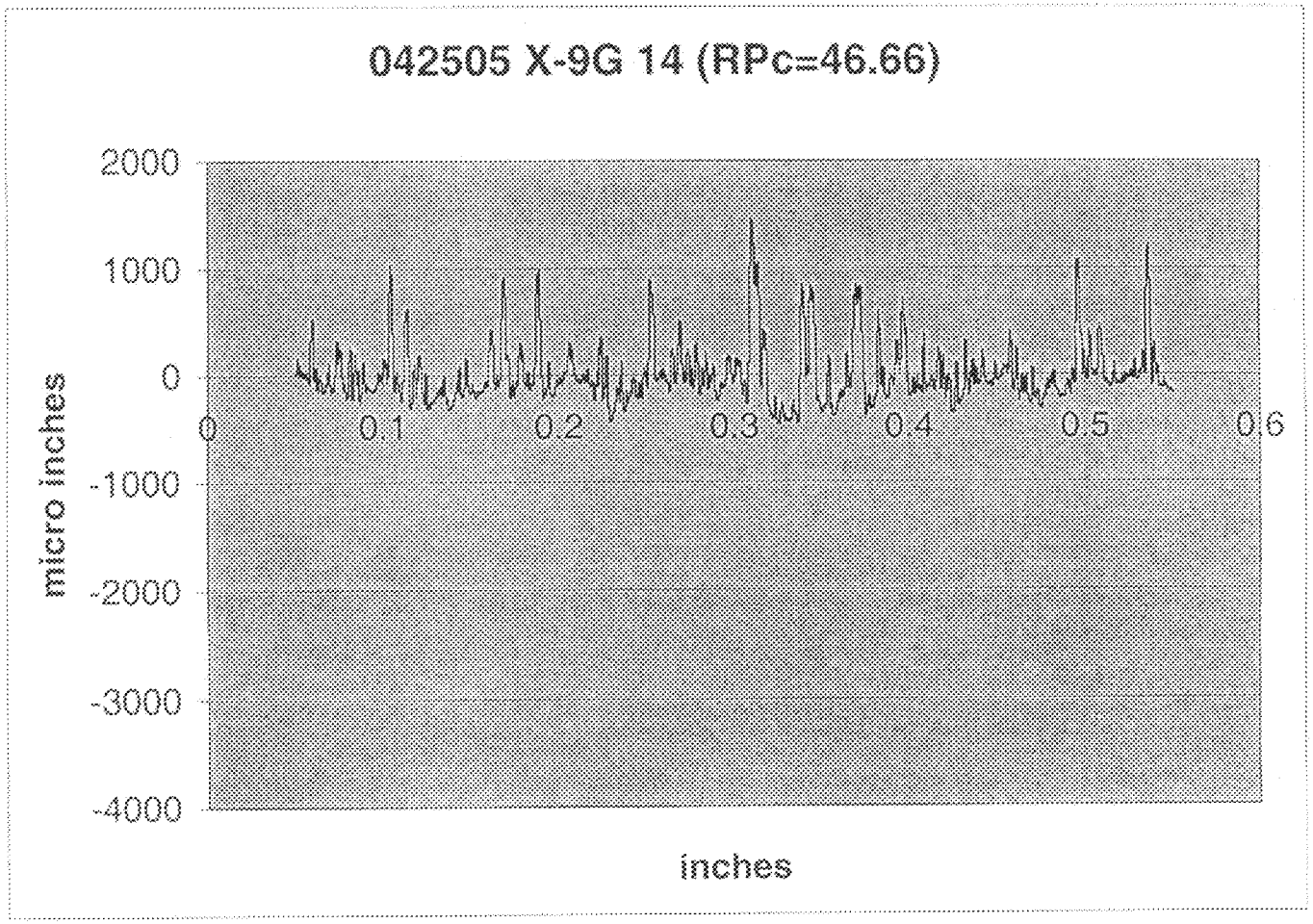
Figure 9:
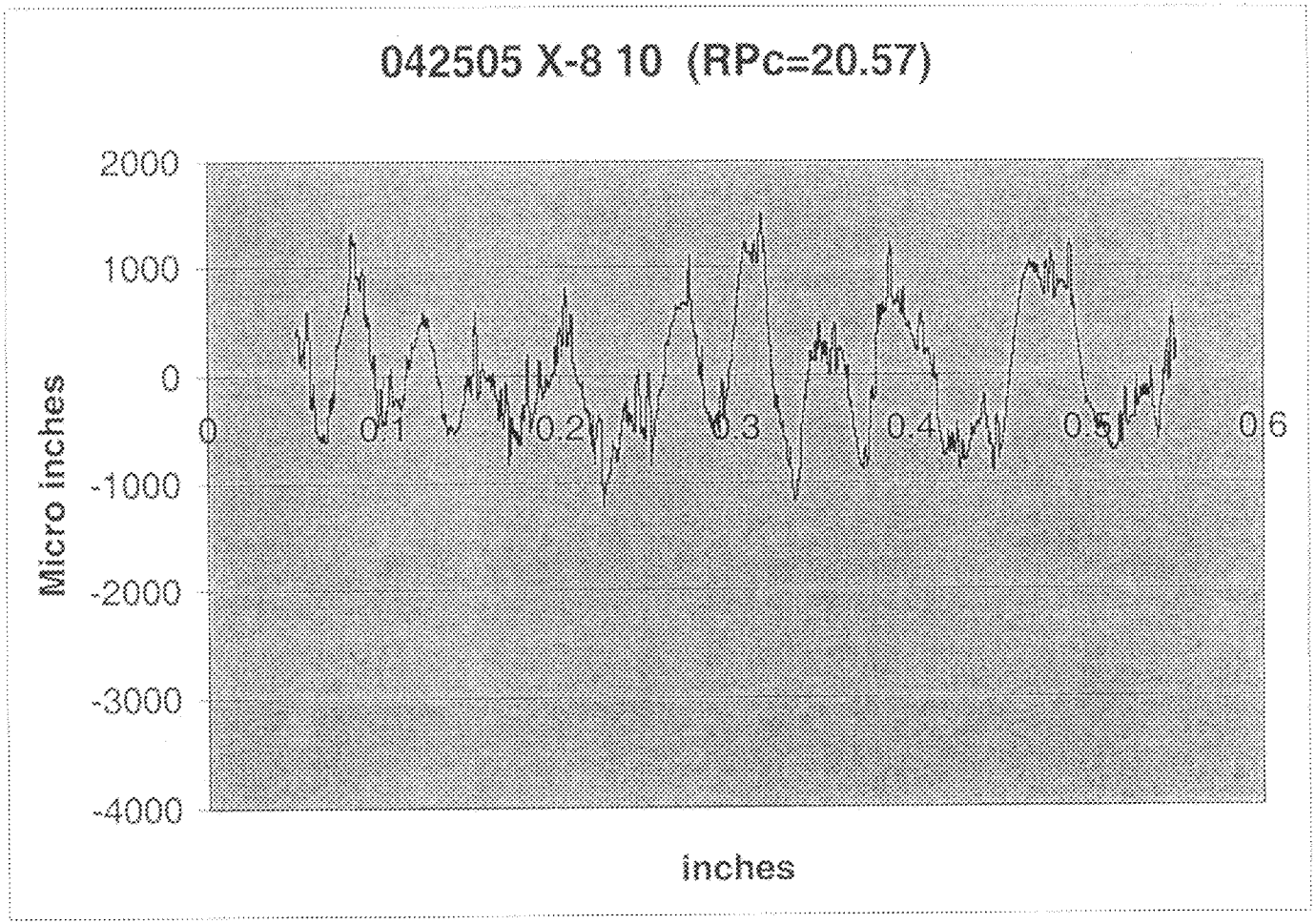
Figure 10:
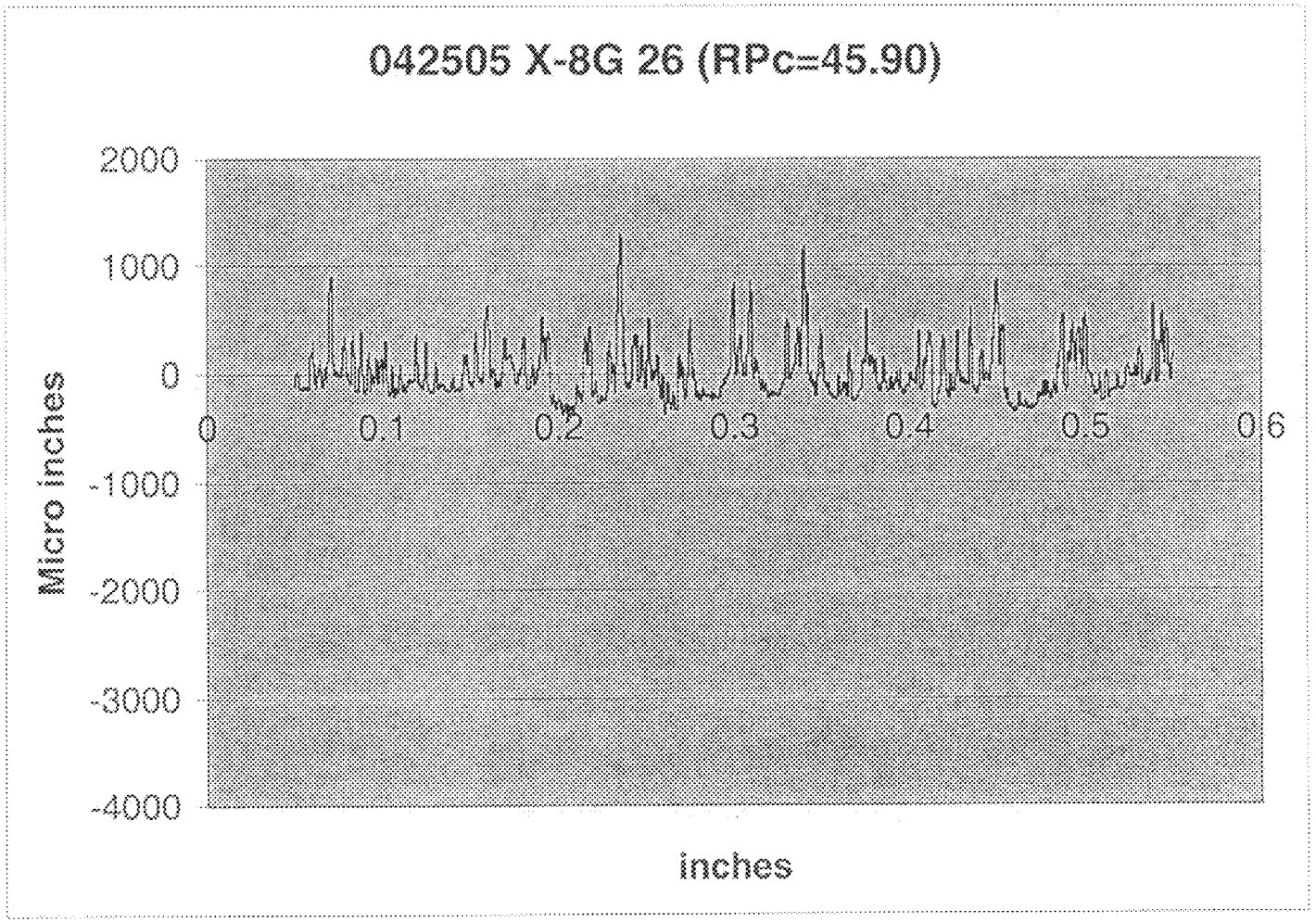
Figure 11:
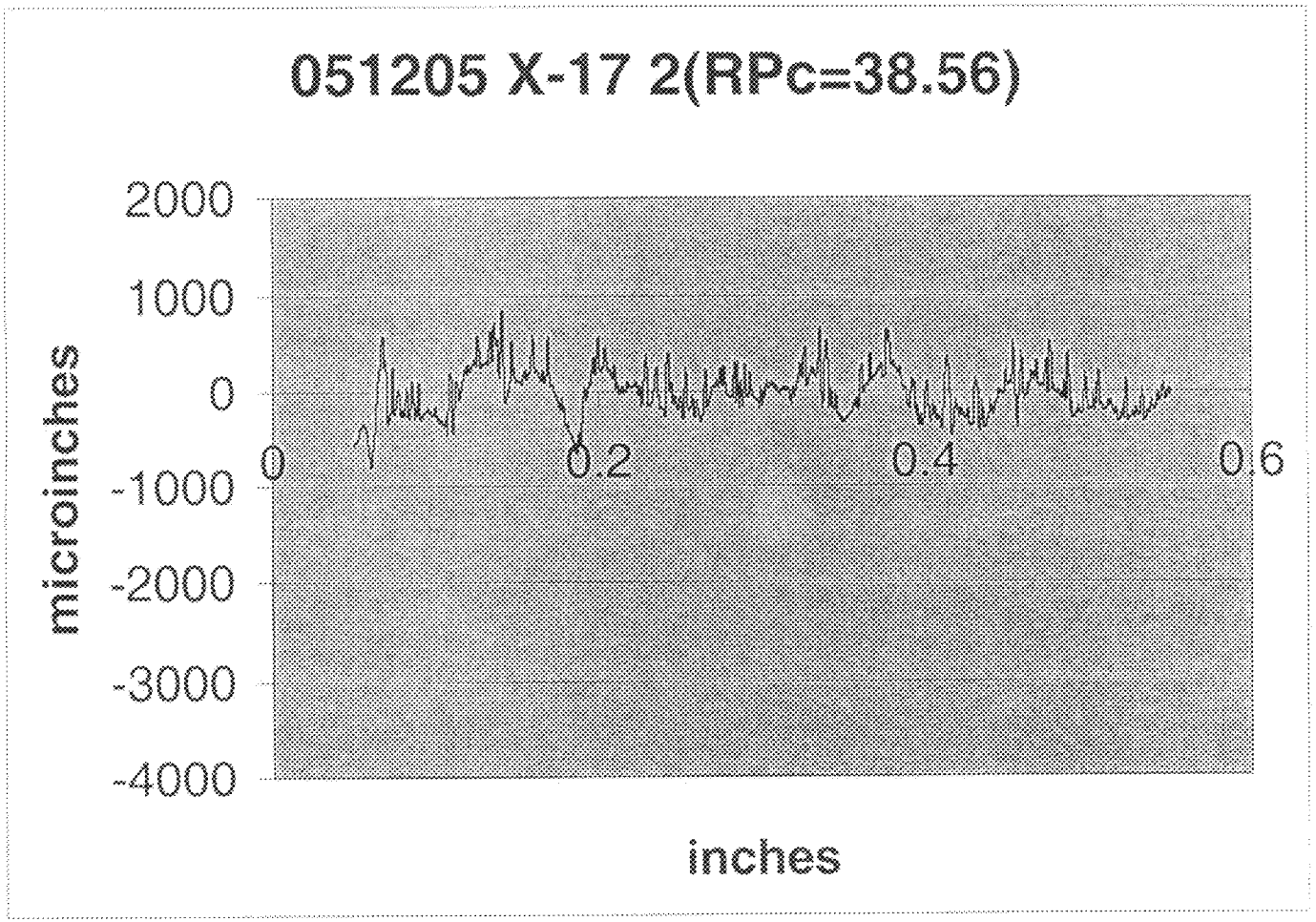
Figure 12:
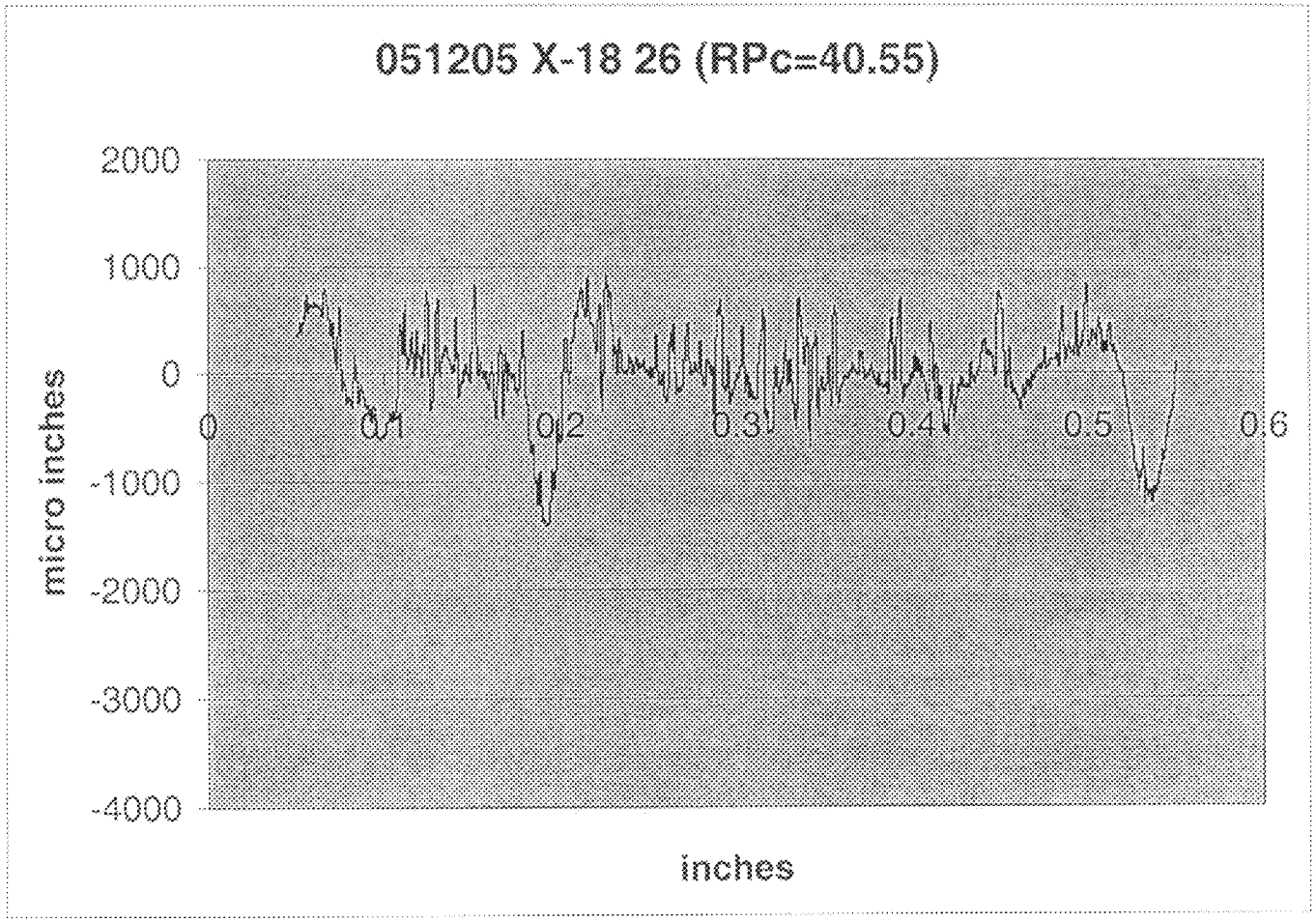
Figure 13:
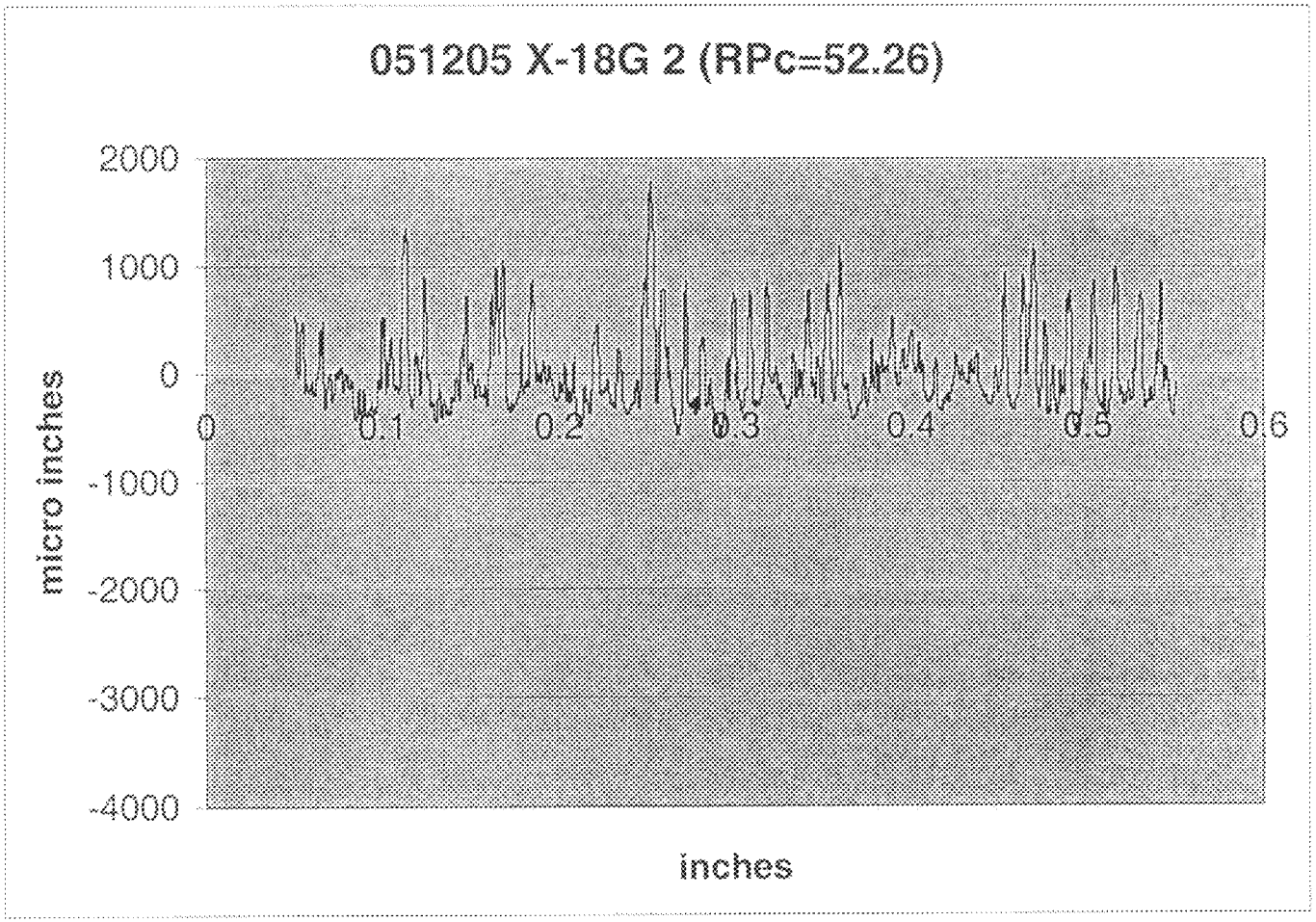
Figure 14:
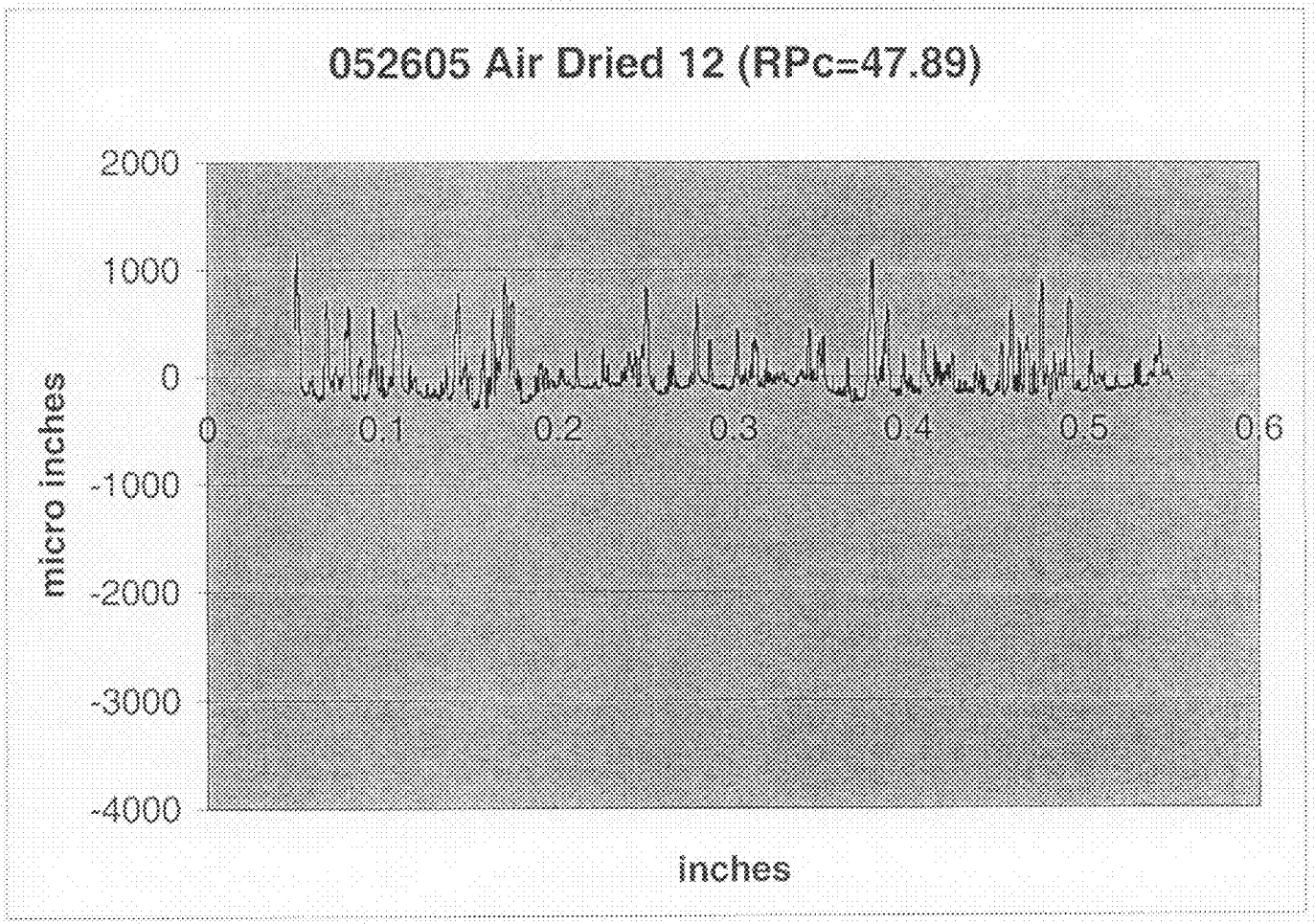
Figure 15:
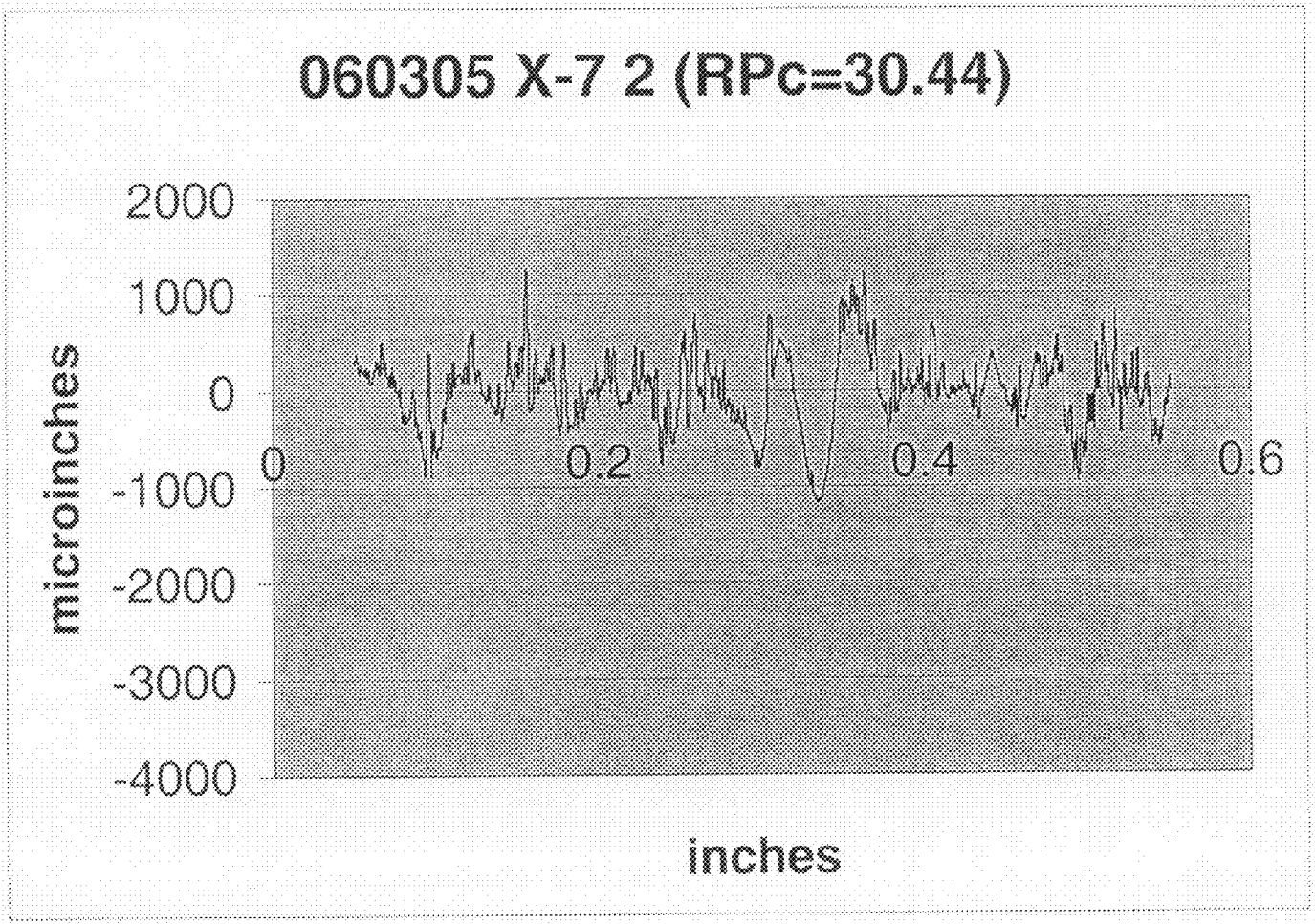
Figure 16:
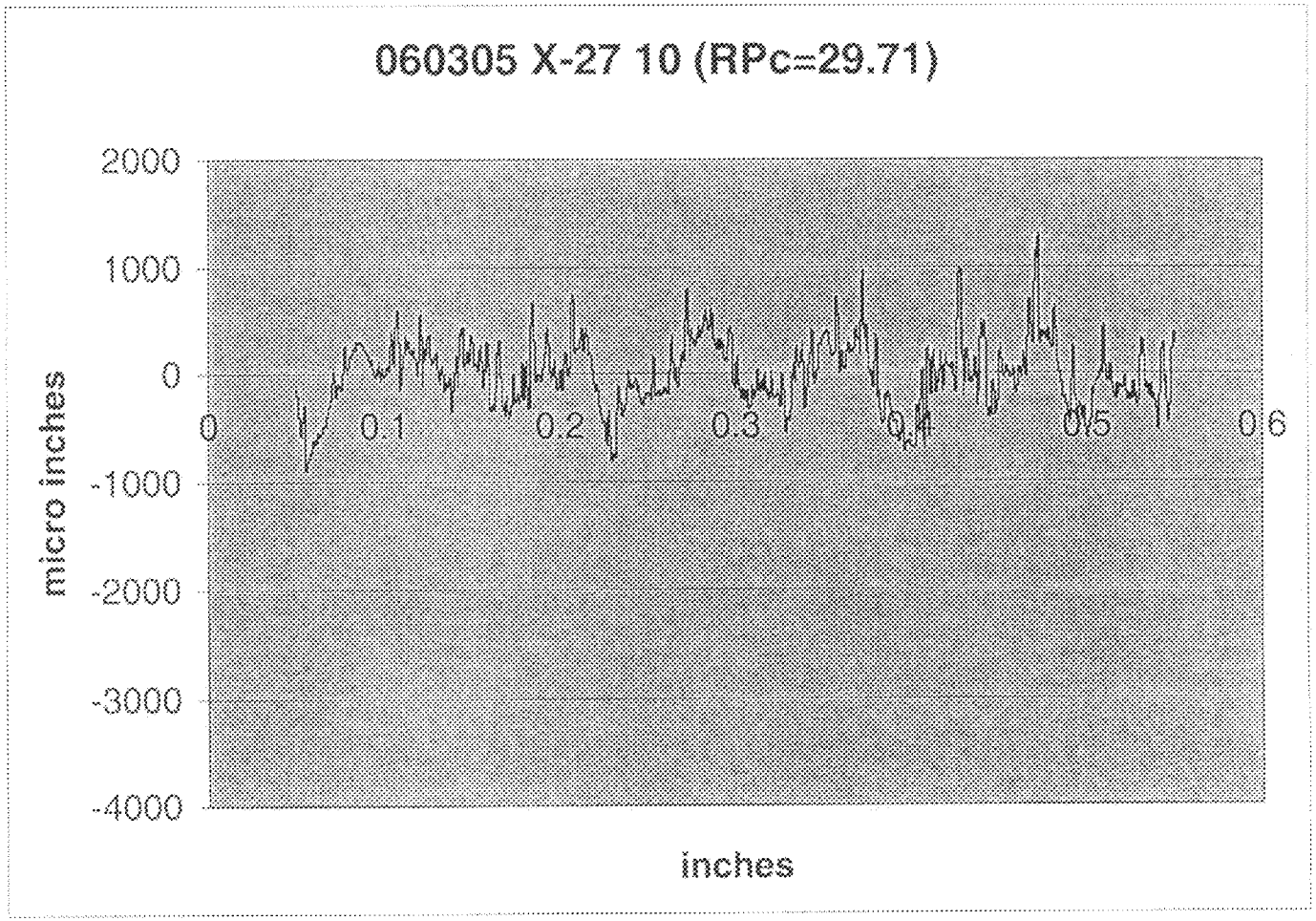
Figure 17:
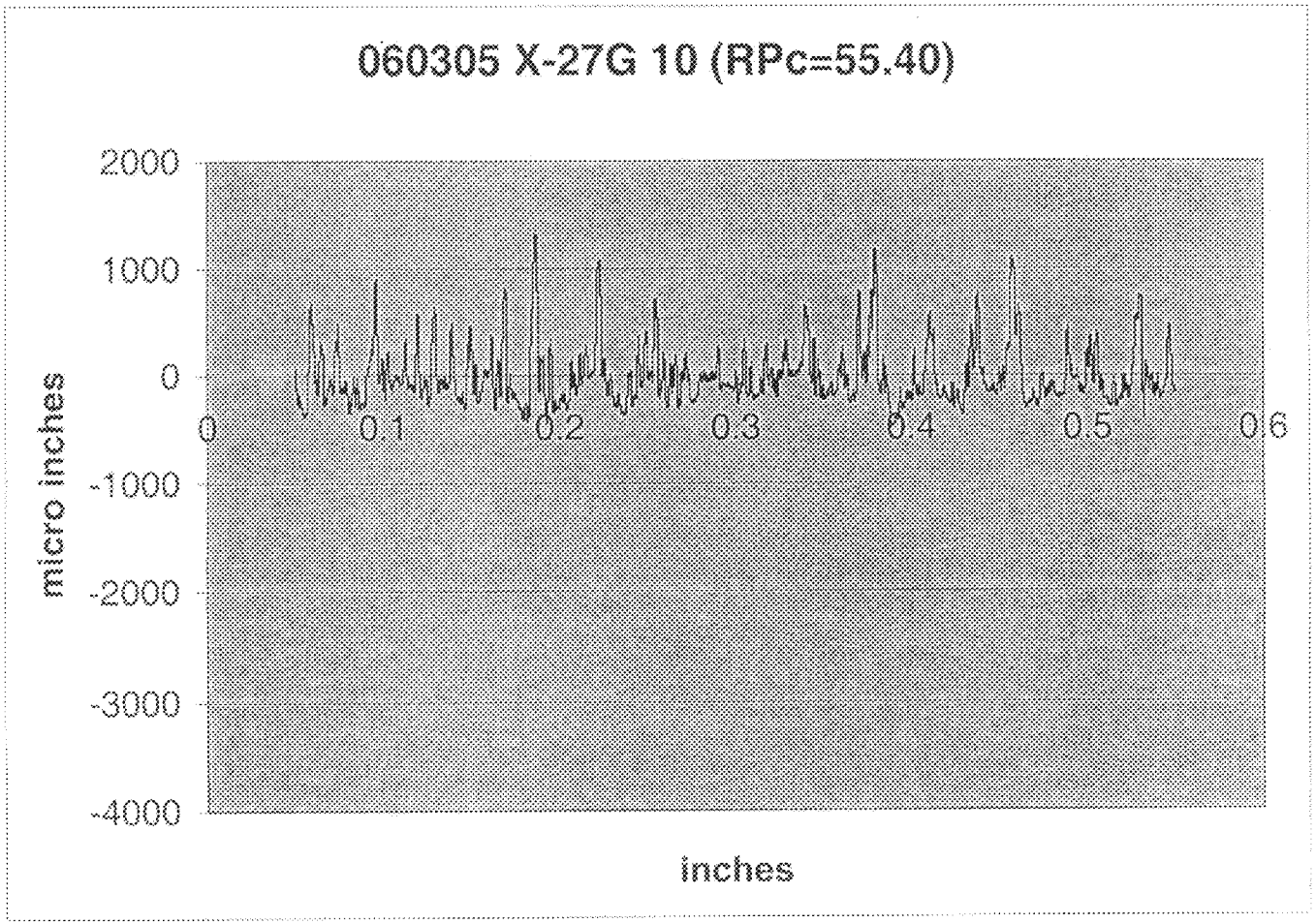
Figure 18:
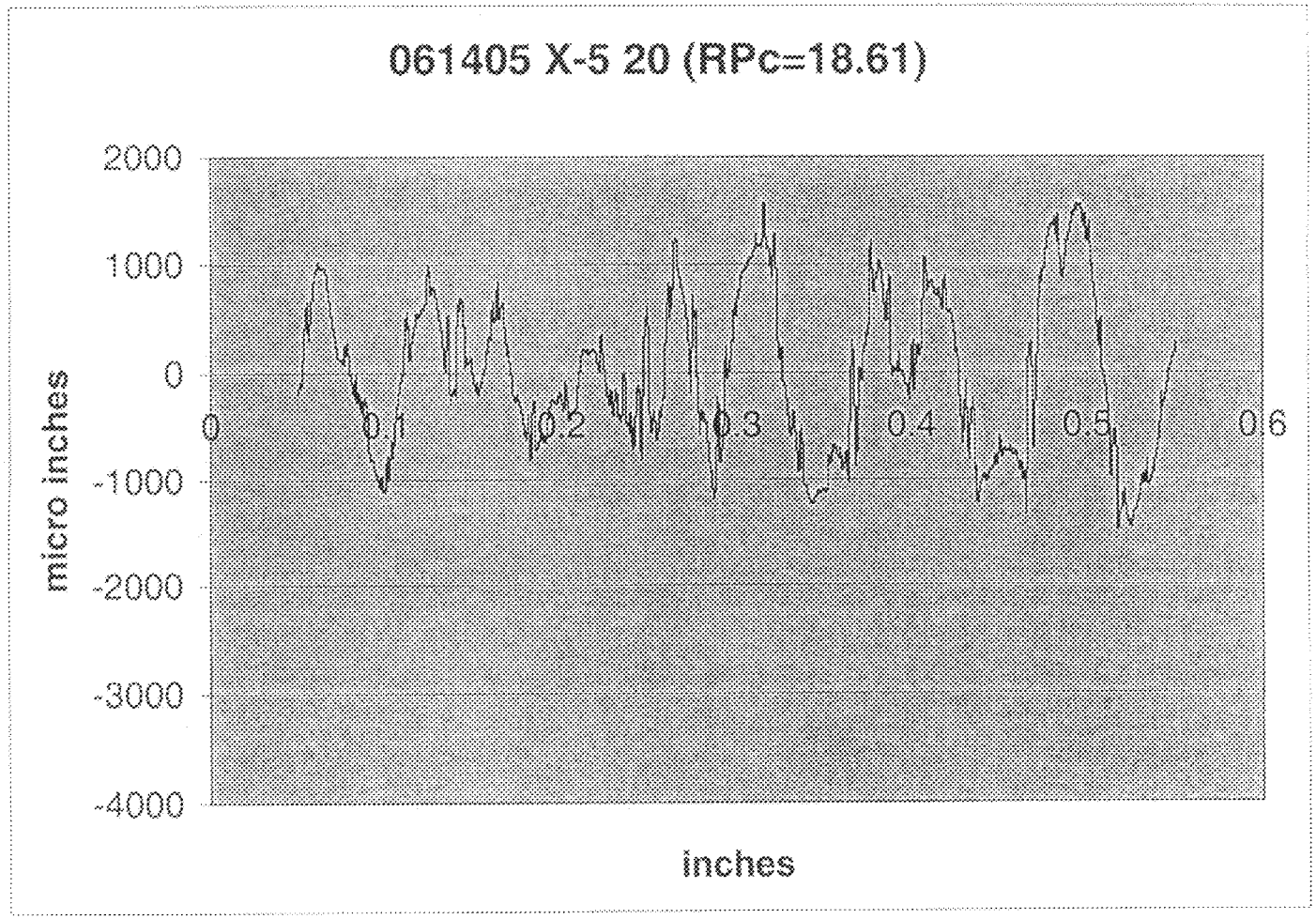
Figure 19:
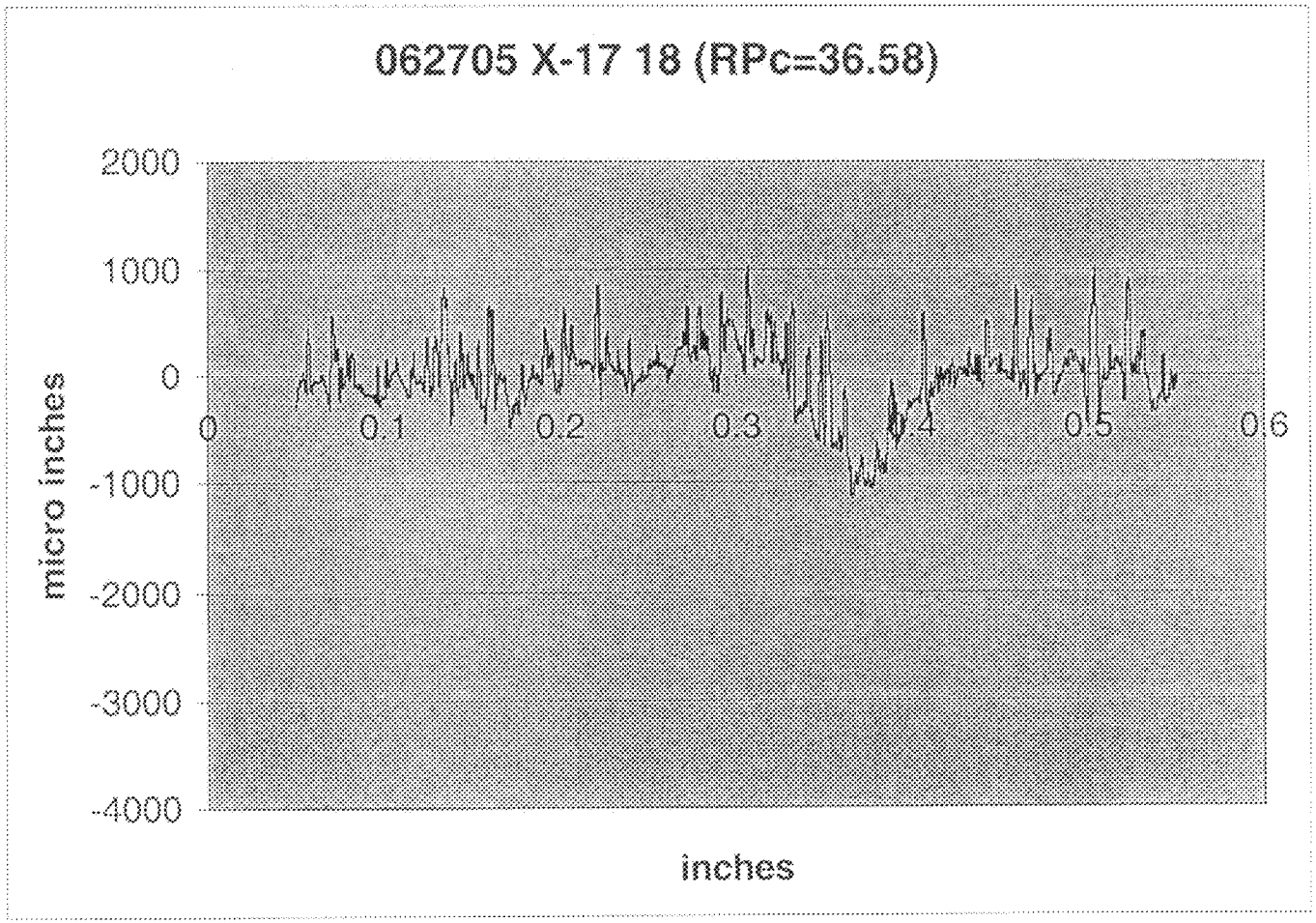
Figure 20:
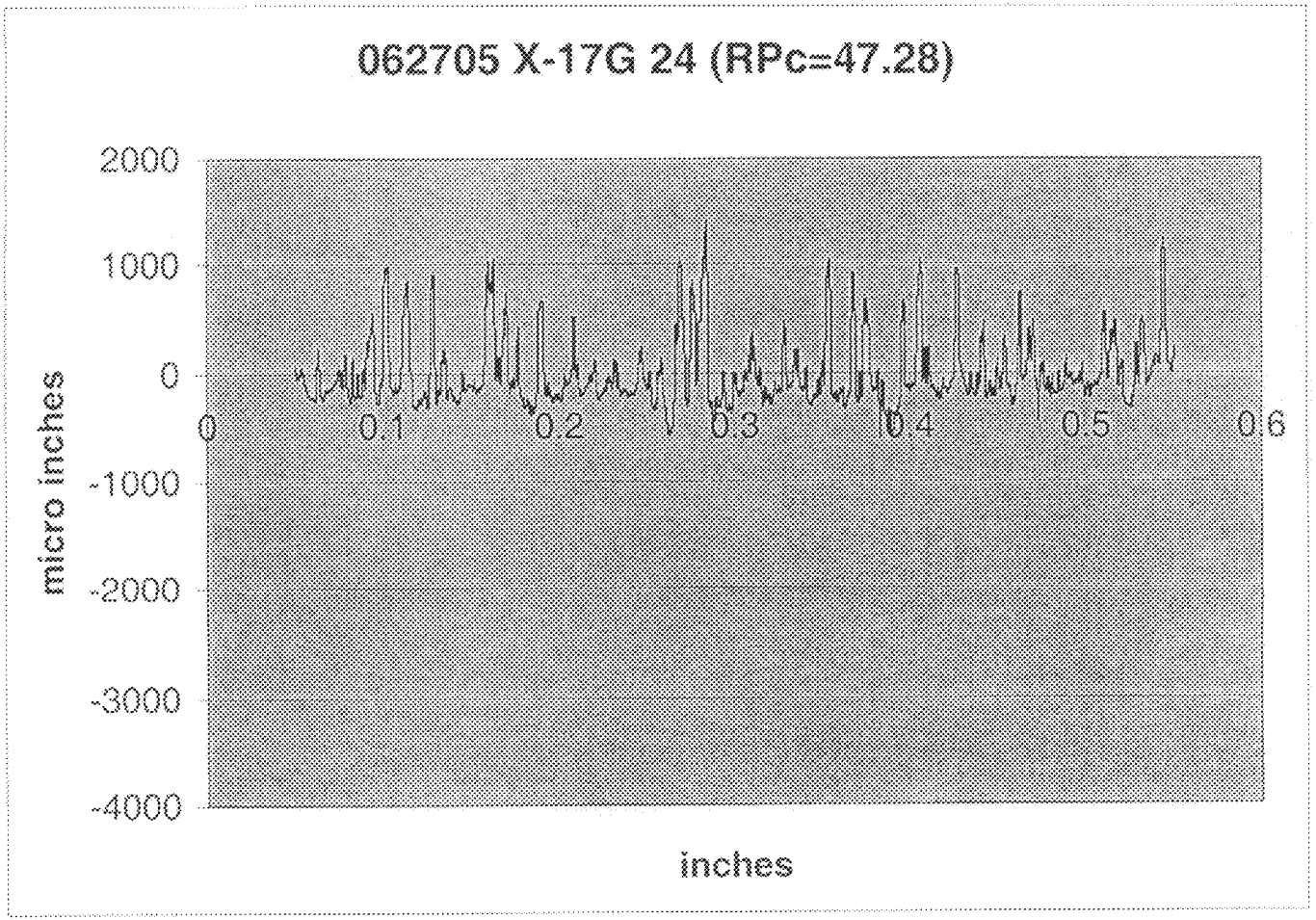
Figure 21:
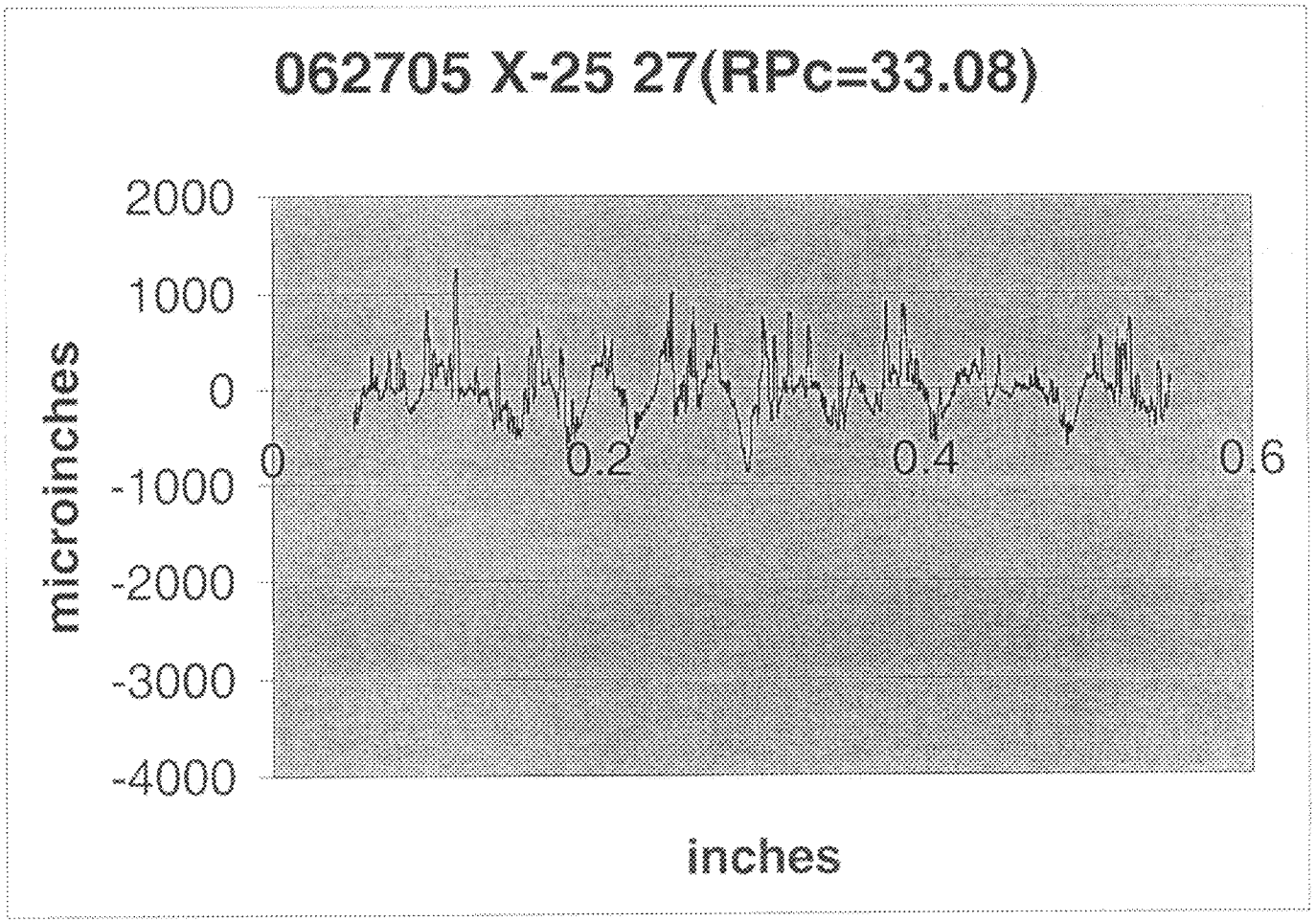

When the process conditions are kept the same, including temperature of the substrate surface, the melting point or softening point of the texture particles, the coating formulation, and the same chemically embossed substrate, different variable textures can be created by using different mechanical embossing tools. See FIGS. 3A and 3B. The higher average pressure resulting from the greater or more numerous peak areas 11, than the lower average pressure resulting from greater or more numerous valley areas 12 of the embossing tool. Note the combination of mechanical embossing tool with peaks and valleys and chemically embossed floor substrate.

The data set forth in the charts labeled "Data-072805" set forth the operating parameters and 60° gloss level of a number of examples made by the process of the present invention. The dates and pattern numbers correspond to the dates and pattern numbers set forth in the column "Level" in the chart labeled "One-way ANOVA: RPc versus Sample ID. Level "041205 X-5" corresponds to pattern X5 and date Apr. 12, 2005 in the Data-072805 chart. The letter "G" in the pattern number means the RPc measurements were taken in the grout lines of the pattern. Without the letter "G" in the pattern number, the RPc measurements were made in the field or up areas of the pattern. The average depth, in mils, of the mechanical embossing rolls used to form the textures listed in the line labeled "Emboss Texture" are as follows:

| Mechanical Embossing Roll | Average Depth (mils) |
|---|---|
| Slate | 16 |
| Wood | 8 |
| Stucco | 12 |
| Linen | 20 |

| Date | Mar. 11, 2005 | Mar. 11, 2005 | Mar. 11, 2005 | Apr. 12, 2005 | Apr. 12, 2005 | Apr. 18, 2005 | Apr. 25, 2005 | Apr. 25, 2005 | May 6, 2005 | May 6, 2005 |
|---|---|---|---|---|---|---|---|---|---|---|
| Time | | | | | | | | | 10:05-10:25 | 2:38 PM |
| Pattern# | 1 | 2 | 3 | 4 | 5 | 6, 7 | 8, 9 | 10 | 11 - bad coating | 12 |
| Gap Setting (mils) | 43 | 50 | 55 | 47 | 75 | 30-45 | 40 | 40 | 40 | 40 |
| Emboss Roll Wrap (%) (100% = 15 inches) | 90 | 100 | 100 | 90 | 75 | 100 | 100 | 100 | 100 | 90 |
| Emboss Texture | Wood | Linen | Linen | Stucco | Linen | Slate | Slate | Wood | Slate | Slate |
| Line Speed (fpm) | 67 | 56 | 70 | 67 | 67 | 64 | 66 | 67 | 65 | 65 |
| Sheet Temperatures | | | | | | | | | | |
| Into Embosser (face/back) | 306/200 | 308/246 | 313/259 | 312/258 | 304/260 | 305/258 | 300/257 | 305/256 | 302/204 | 304/201 |
| Exit Embosser | 229 | 233 | 245 | 224 | 251 | 237 | 238 | 221 | 241 | 238 |
| Roll Temperatures | | | | | | | | | | |
| Emboss Roll | 98 | 83 | 86 | 92 | 75 | 97 | 100 | 103 | 95 | 96 |
| Gloss (60 deg.) | 6 | 9 | 9 | 9 | 9 | 6-7 | 7 | 7 | | 11 |

| Date | May 6, 2005 | May 6, 2005 | May 6, 2005 | May 6, 2005 | May 12, 2005 | May 19, 2005 | May 19, 2005 | May 26, 2005 | May 26, 2005 | May 26, 2005 |
|---|---|---|---|---|---|---|---|---|---|---|
| Time | 3:15 PM | 4:00 PM | 6:14 PM | 7:00 PM | 1:50-6:00 PM | 5:45 PM | 6:10 PM | | 1:20 PM | 2:25 PM |
| Pattern# | 12 | 13 | 13 | 14 | 15, 16, 17, 18 | 19 | 10, 19, 20, 21, 22 | 6, 23, 24 | 25 | 26 |
| Gap Setting (mils) | 40 | 40 | 39 | 39 | 55 | 61 | 61 | 40 | 40 | 40 |
| Emboss Roll Wrap (%) (100% = 15 inches) | 89 | 89 | 89 | 89 | 100 | 55 | 55 | 100 | 100 | 100 |
| Emboss Texture | Slate | Slate | Slate | Slate | Stucco | Wood | Wood | Slate | Slate | Slate |
| Line Speed (fpm) | 65 | 65 | 65 | 67 | 67 | 67 | 67 | 63-68 | 66 | 67 |
| Sheet Temperatures | | | | | | | | | | |
| Into Embosser (face/back) | 303/201 | 300/202 | 300/200 | 301/201 | ~300/259 | 282/230 | ~290/240 | 305/198 | ~300/200 | ~300/200 |
| Exit Embosser | 239 | 240 | 241 | 242 | 220 | 236 | | 224 | | |
| Roll Temperatures | | | | | | | | | | |
| Emboss Roll | 96 | 96 | 94 | 97 | 88 | 85 | | 95 | | |
| Gloss (60 deg.) | 11 | 8 | 8 | 6 | 7-10 | 8 | 6-10 | 6-8 | 7 | 5 |

| Date | May 26, 2005 | May 26, 2005 | Jun. 3, 2005 | Jun. 3, 2005 | Jun. 3, 2005 | Jun. 9, 2005 | Jun. 14, 2005 | Jun. 27, 2005 | Jun. 27, 2005 | Jun. 27, 2005 |
|---|---|---|---|---|---|---|---|---|---|---|
| Time | 2:40 PM | 2:49 PM | 1:10 PM | 1:30 PM | | | | | | |
| Pattern# | 26 | 26 | 27 | 27 | 7, 28, 29 | 8, 30, 31, 32, 33 | 5, 34, 35, 36, 37 | 15, 17 | 18 | 25, 38 |
| Gap Setting (mils) | 45 | 48 | 56 | 56 | 56 | 51 | 49-51 | 50 | 45 | 45 |
| Emboss Roll Wrap (%) (100% = 15 inches) | 70 | 70 | 100 | 100 | 100 | 100 | 100 | 100 | 100 | 100 |
| Emboss Texture | Slate | Slate | Slate | Slate | Slate | Slate | Slate | Stucco | Stucco | Slate |
| Line Speed (fpm) | 67 | 67 | 65 | 65 | 65 | 65 | 63-67 | 64 | 62 | 62 |
| Sheet Temperatures | | | | | | | | | | |
| Into Embosser (face/back) | ~300/200 | ~300/200 | 287/174 | ~290/185 | ~295/180 | ~300/200 | ~300/200 | 298/248 | 297/209 | ~290/205 |
| Exit Embosser | | | 229 | | | | | 226 | 221 | |
| Roll Temperatures | | | | | | | | | | |
| Emboss Roll | | | 89 | | | | | 88 | 88 | |
| Gloss (60 deg.) | 5 | 5 | 7 | 7 | 5-6 | 7-9 | 6-7 | 9-10 | 7 | 7-8 |

The temperatures set forth in the Data-072805 are ° F. The "Into Embosser (face/back)" with the "~" symbol are estimations.

The One-way ANOVA chart sets forth the mean and standard deviation for 30 measurements of RPc per sample. See the definitions following the charts.

individual 95% confidence intervals for mean is based on pooled standard deviation (StDev)—an estimate of the common standard deviation for all samples. It is necessary to redo the statistic analysis for specific group of samples needed to be compared with. For example, the One-way ANOVA chart below shows the analysis results to compare sample "041205

One-way ANOVA: RPc versus Sample ID

| Source | DF | SS | MS | F | P |
|---|---|---|---|---|---|
| Sample ID | 17 | 77317 | 4548 | 44.10 | 0.000 |
| Error | 522 | 53839 | 103 | | |
| Total | 539 | 131155 | | | |

S = 10.16 R-Sq = 58.95% R-Sq(adj) = 57.61%

Individual 95% CIs For Mean Based on Pooled StDev

| Level | N | Mean | StDev |
|---|---|---|---|
| 041205 X-5 | 30 | 22.72 | 4.15 |
| 041805 X-7 | 30 | 26.39 | 5.45 |
| 042505 X-10 | 30 | 13.72 | 3.22 |
| 042505 X-9 | 30 | 25.67 | 7.25 |
| 042505 X-9G | 30 | 46.10 | 11.13 |
| 042505 X-8 | 30 | 20.31 | 3.56 |
| 042505 X-8G | 30 | 45.61 | 8.11 |
| 051205 X-17 | 30 | 39.22 | 11.65 |
| 051205 X-18 | 30 | 38.18 | 20.01 |
| 051205 X-18G | 30 | 52.30 | 11.93 |
| 052605 air dry | 30 | 47.60 | 14.99 |
| 060305 X-7 | 30 | 31.00 | 8.38 |
| 060305 X-27 | 30 | 29.74 | 9.15 |
| 060305 X-27G | 30 | 55.46 | 9.46 |
| 061405 X-5 | 30 | 18.57 | 4.20 |
| 062705 X-17 | 30 | 37.70 | 13.46 |
| 062705 X-17G | 30 | 46.53 | 9.42 |
| 062705 X-25 | 30 | 33.51 | 10.49 |

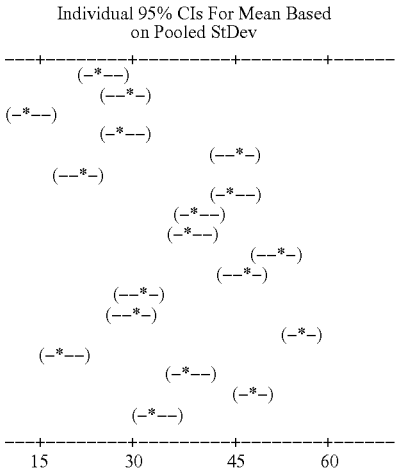

Pooled StDev = 10.16

Each asterisk represents a sample mean. Each set of parentheses encloses a 95% confidence interval for the mean of a population. You can be 95% confident that the population mean for each level is within the corresponding interval. If the intervals for two means do not overlap, it suggests that the population means are different. In other words, there is a significant statistical difference between two RPc values if the interval for the two means do not overlap. However, above X-5" and sample "061405 X-5". The analysis results indicated that there is a significant statistical difference on measured RPc values between the two floor samples made on Apr. 12, 2005 and Jun. 14, 2005, even though they have the same pattern number X-5. The data set forth in the chart labeled "Data-072805" can explain how to make such variable textures on the same pattern.

One-way ANOVA: RPc versus Sample ID

| Source | DF | SS | MS | F | P |
|---|---|---|---|---|---|
| Sample ID | 1 | 259.0 | 259.0 | 14.86 | 0.000 |
| Error | 58 | 1011.3 | 17.4 | | |
| Total | 59 | 1270.4 | | | |

S = 4.176 R-Sq = 20.39% R-Sq(adj) = 19.02%

| Level | N | Mean | StDev | Individual 95% CIs For Mean Based on Pooled StDev |
|---|---|---|---|---|
| 041205 X-5 | 30 | 22.721 | 4.149 | (-----+----) |
| 061405 X-5 | 30 | 18.565 | 4.202 | (-----+----) |

---+---------+---------+---------+------
18.0 20.0 22.0 24.0

Pooled StDev = 4.176

Glossary/Abbreviations Used in the One-Way ANOVA Data Chart.

Source: Each potential cause of variability in the data is called a source. In a one-way ANOVA, two sources of variability are analyzed: the factor of interest and error.

Degrees of freedom (DF): The degrees of freedom are used to calculate the mean square (MS). In general, the degrees of freedom measure how much "independent" information is available to calculate each sum of squares (SS).

Note

DF total=DF for the factor+DF for error

DF total=n−1, where n is the total number of observations

DF for factor=k−1, where k is the number of levels of the factor

DF for error=n−k

Sum of squares (SS): The sum of squares is also called the sum of the squared deviations. The total sum of squares measures the total variability in the data. This variability is made up of two sources:

- the sum of squares for the factor, which measures how much the factor level means differ
- the sum of squares for error, which measures how much the individual observations differ from their corresponding factor level means.

Mean squares (MS): The mean square for each source is simply the sum of squares (SS) divided by the degrees of freedom (DF). The mean squares for error are an estimate of the variance in the data left over after differences in the means have been accounted for.

F: F is the statistic used to test the hypothesis that all the factor level means are equal. It is calculated as the mean square for the factor divided by the mean squares for error. F is used to determine the p-value.

p-value (P): P is the probability that you would have obtained samples as different (or more different) if there really is no difference between the level means in the population. Use the p-value to decide if the means are different:

- If P is less than or equal to the a-level you have selected, you can conclude that the means are different.
- If P is greater than the a-level you selected, you cannot conclude that the means are different.

S: see Pooled StDev below.

R-squared (R-Sq): The coefficient of determination or multiple determinations (in multiple regressions). R-Sq is the percentage of total variation in the response that is explained by predictors or factors in the model. In general, the higher the R-Sq, the better the model fits your data. R-Sq is always between 0 and N: The number of observations included for each level of the factor.

R-squared adjusted (R-Sq (adj): Accounts for the number of predictors or factors in your model. Adjusted R2 is useful for comparing models with different numbers of predictors or factors. For example, adjusted may actually decrease when another predictor is added to the model, because any decrease in error sum of squares may be offset by the loss of the degree of freedom.

Level: A one-way ANOVA compares the means for several groups. The groups are called the levels of the factor in the analysis.

N: The number of observations for the level.

Mean: The mean of the observations for the indicated factor level.

Standard deviation (StDev): The StDev for a given level is the sample standard deviation calculated using the observations for that level.

Pooled standard deviation (Pooled StDev): An estimate of the standard deviation for the population. Analysis of variance procedures assume that all levels have the same population standard deviation. This standard deviation is estimated by "pooling" information about the standard deviations for all the levels to get the pooled standard deviation.

The definition of RPc is set forth in the Mitutoyo Surface Texture Parameter User's Manual. The set-up conditions used for the profilometer readings and graphs of surface profiles are set forth in the chart labeled "Set-up conditions used for profilometer readings" below.

Set-Up Conditions Used for Profilometer Readings

| Evaluation Conditions: |
|---|
| standard - ANSI 1995 |
| kind of profile - R_ANSI |
| smplg length (le) - 0.1 inch |
| no of smplg (nle) - 5 |
| Lc - 0.1 inch |
| Ls - 0.0003 inch |
| kind of filter - Gaussian |
| EvLtn length (lm) - 0.5 inch |
| pre-travel - 0.05 inch |
| post-travel - 0.04055 inch |
| smooth connection - off |
| Evaluation Section: |
| profile - R_ANSI - Section = [1] |
| speed - 0.02 inch/s |
| range - 32000.0 inch |

-continued

| Measurement Conditions: |
|---|
| measurement length - 0.59055 inch |
| measurement start P - 0.0 inch |
| column escape - 0.0 inch |
| measurement axis E - return |
| auto leveling - off |
| range - 32000.0 inch |
| speed - 0.02 inch/s |
| R-surface auto-mea. - off |
| over range - abort |
| stylus start position - 0.0 uinch |
| pitch - 49.2126 uinch |
| number of points - 12000 |
| machine - SJ-402 |
| measurement axis - drive unit (50 mm) |
| detector - for SJ-400 (0.75 mN) |
| stylus - standard (12AAC731-12AAB355) |
| polar reversal - off |
| straightness comp. - off |
| arm compensation - off |
| stylus radius comp. - off |
| auto-notch (+) - off |
| auto-notch (−) - off |
| compensation method - off |

The graphs of micro inches vs. inches (FIGS. 4 to 22) show the surface profiles of the various samples as measured by the Mitutoyo Surface meter. The charts were selected of the samples having a RPC close to the mean RPC of the 30 measurements. The number following the date and pattern number is the measurement. "041205 X-5 21 (RPc=22.64)" was the 21$^{st}$ RPc measurement of pattern X5 made on Apr. 12, 2005. The measured average RPc value was 22.64.

Figure 22:
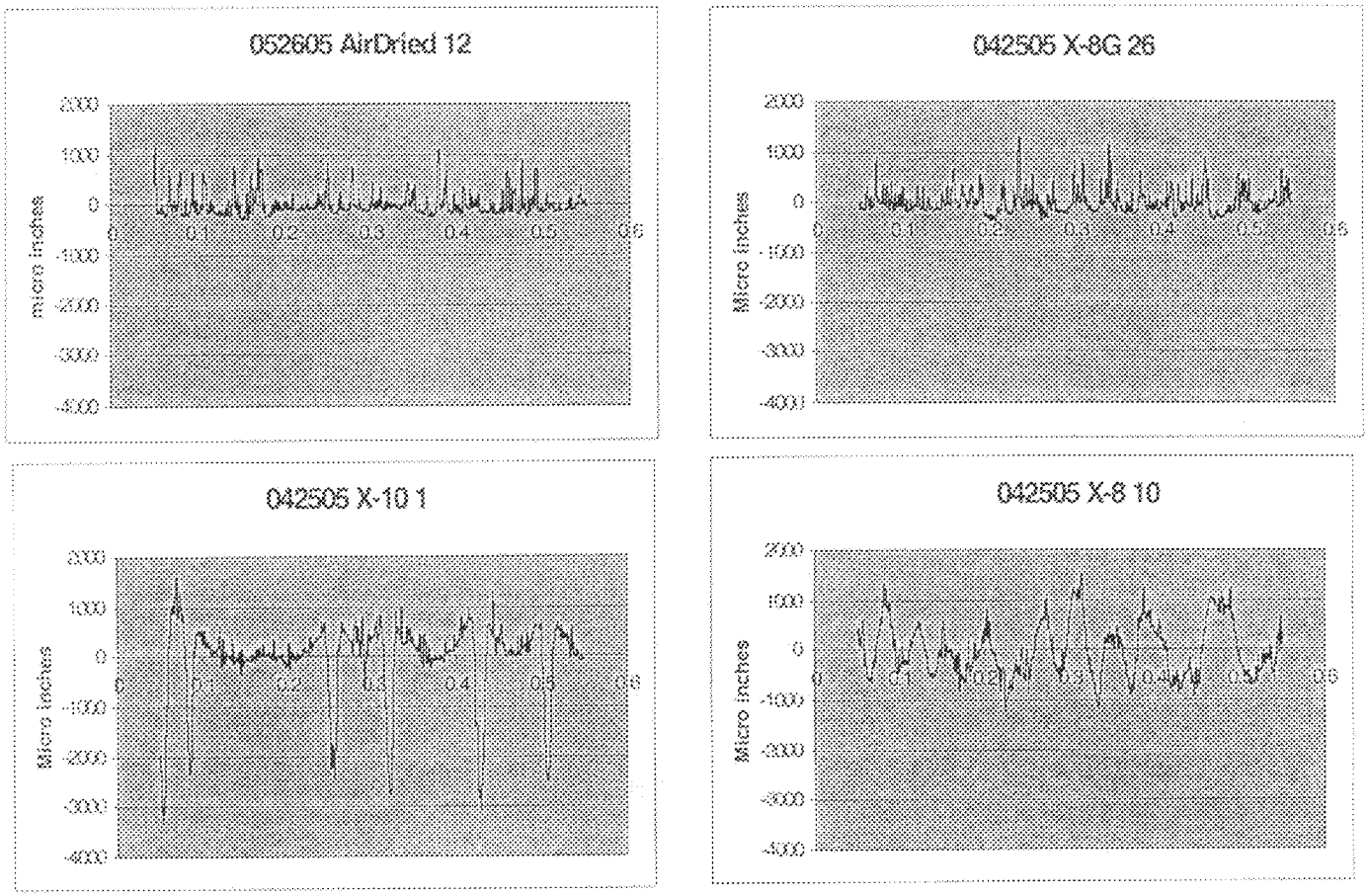
Figure 24:
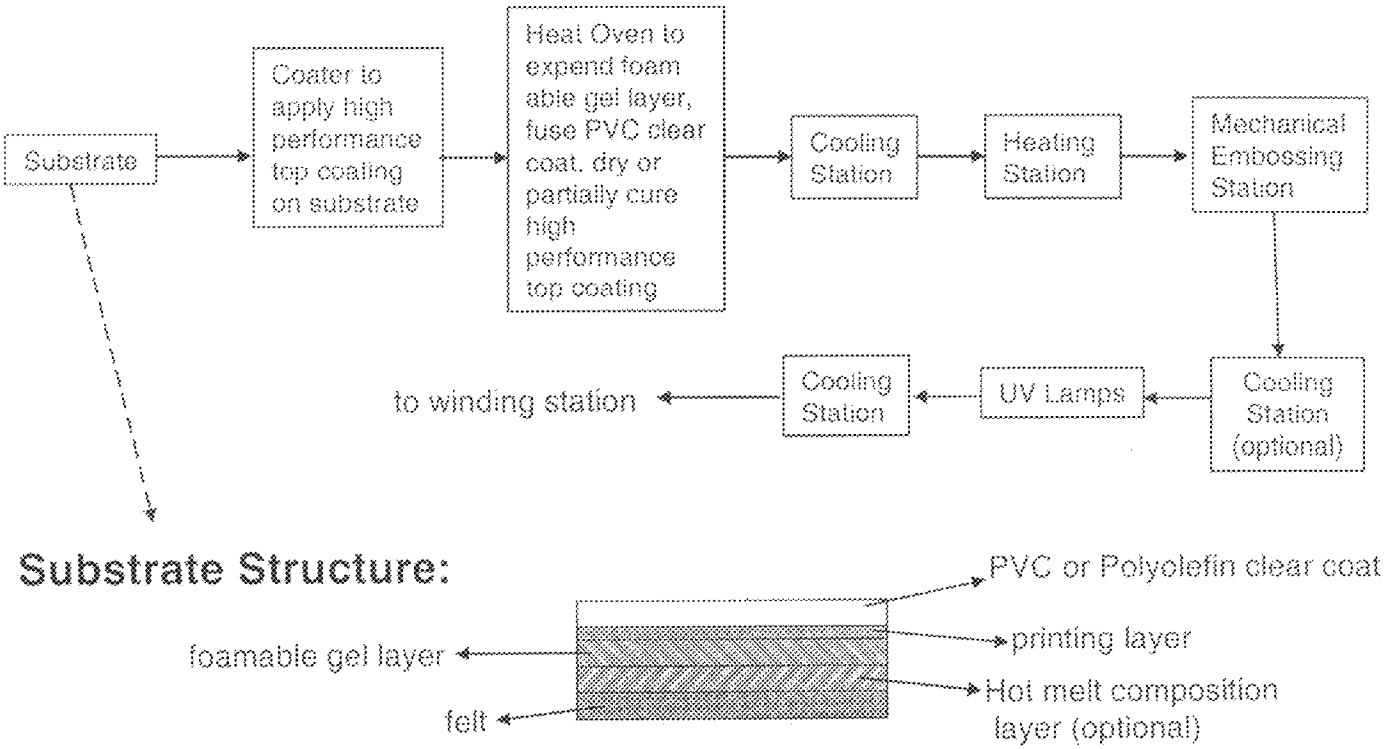
Figure 26:
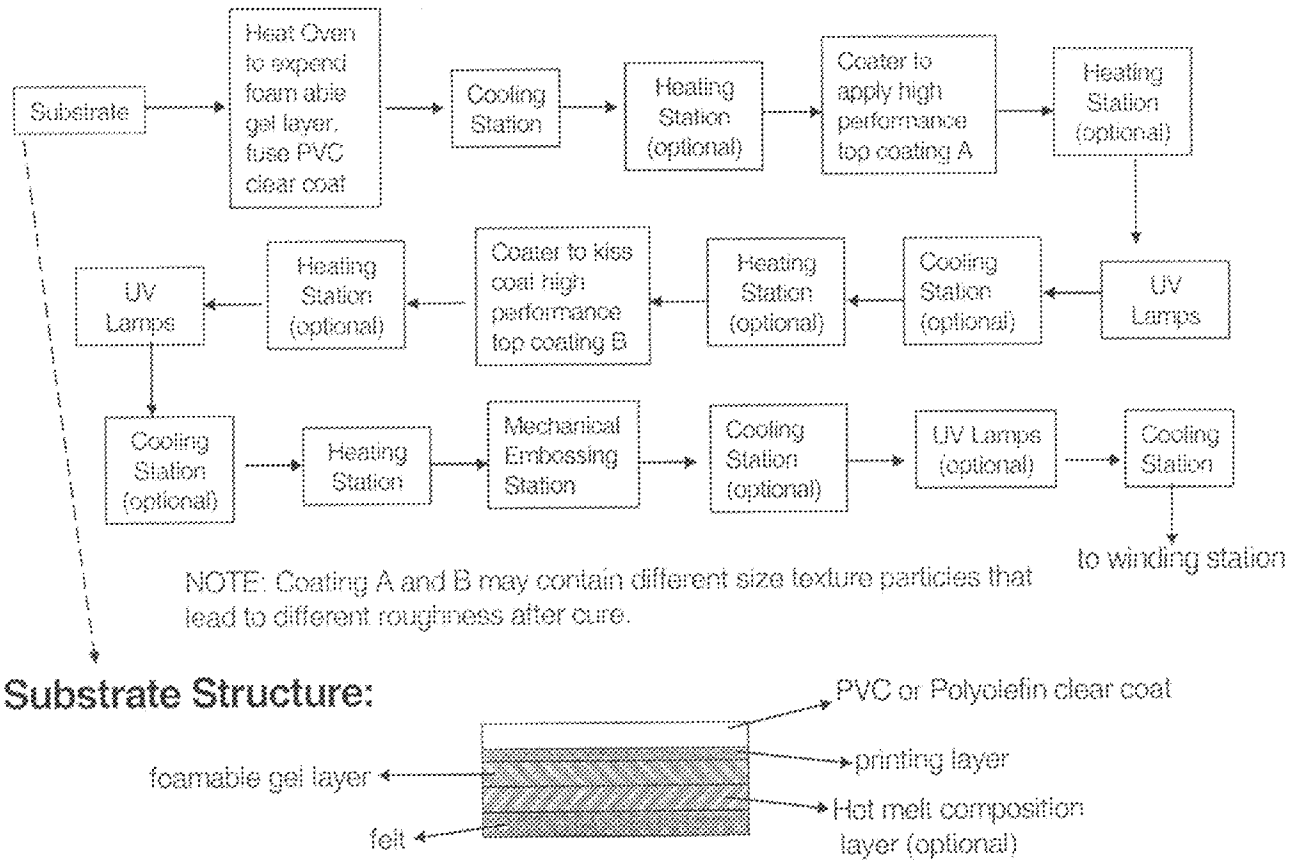
Figure 27:
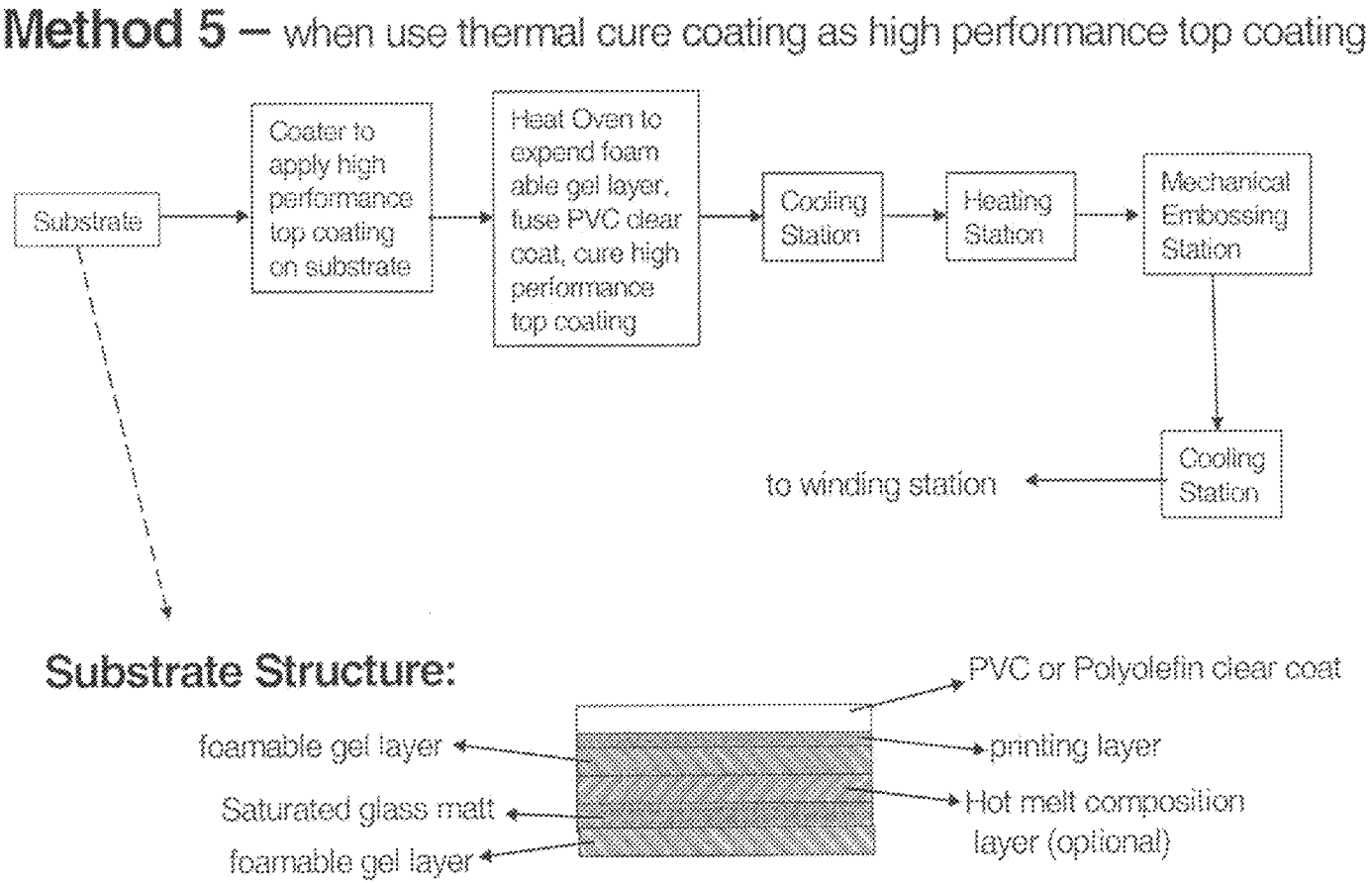
Figure 28:
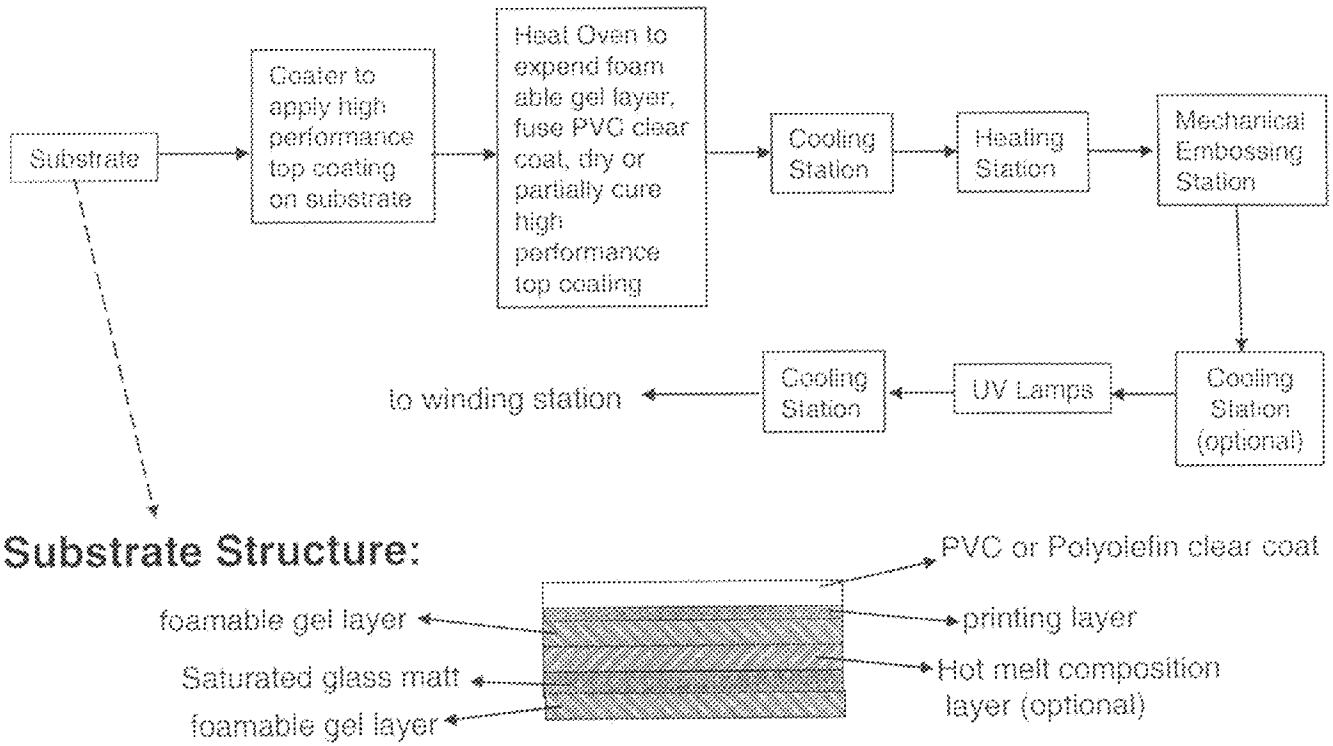
Figure 29:
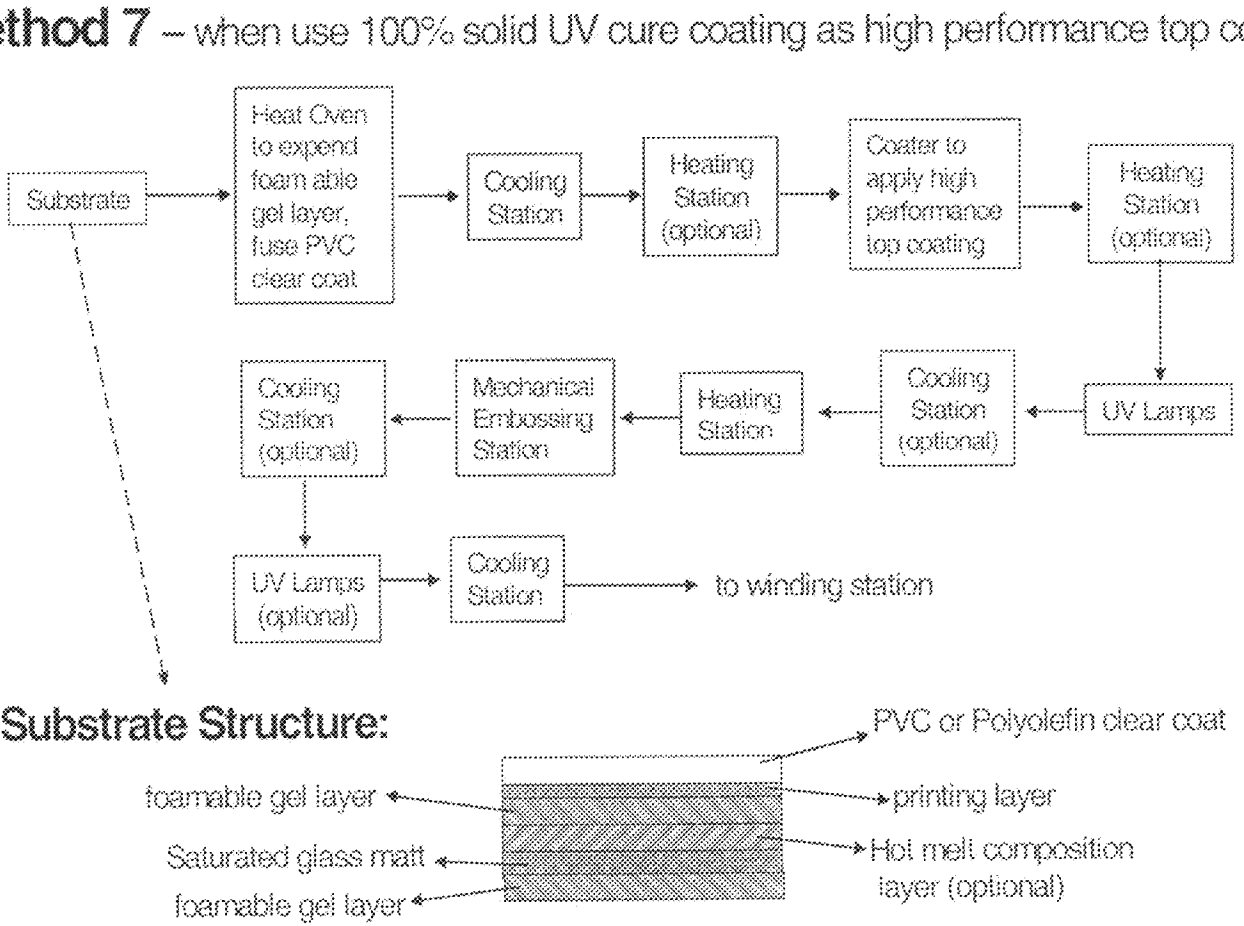
Figure 31:
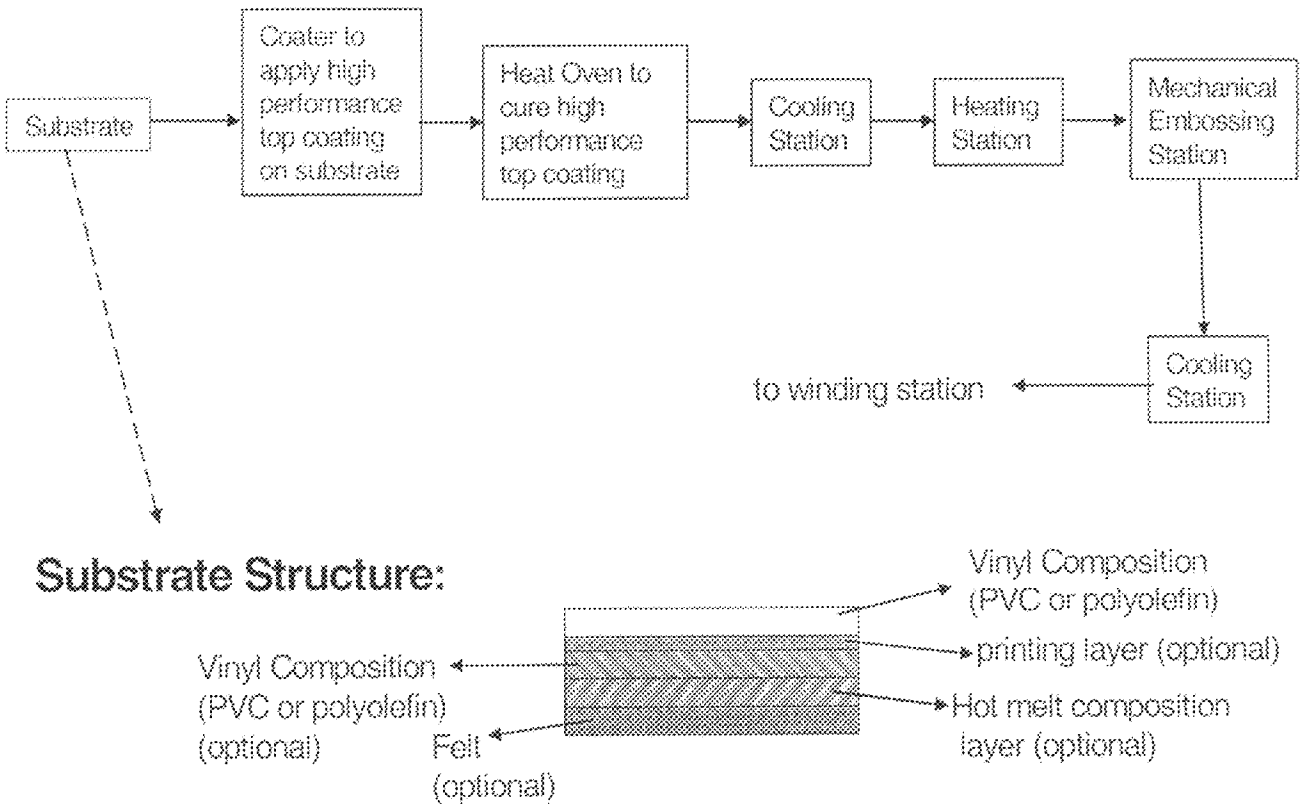
Figure 32:
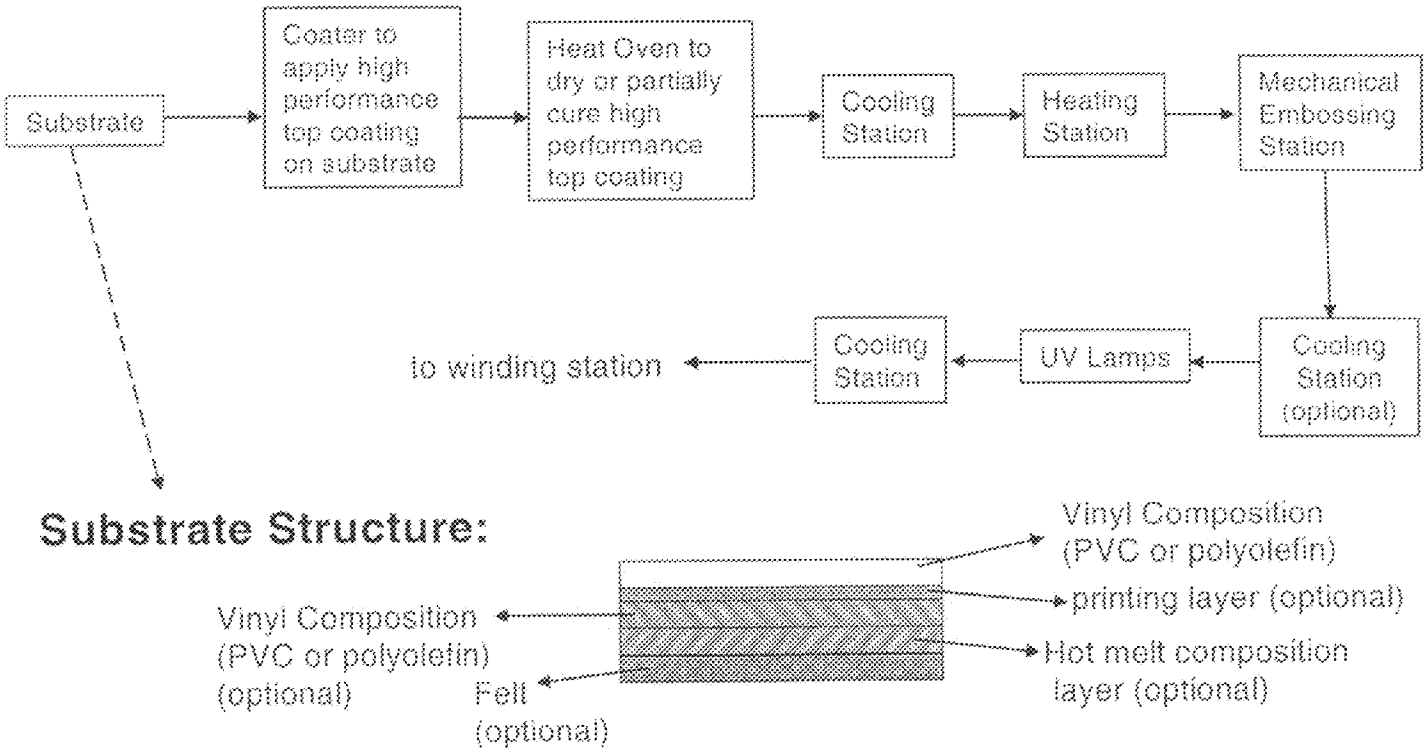
Figure 33:
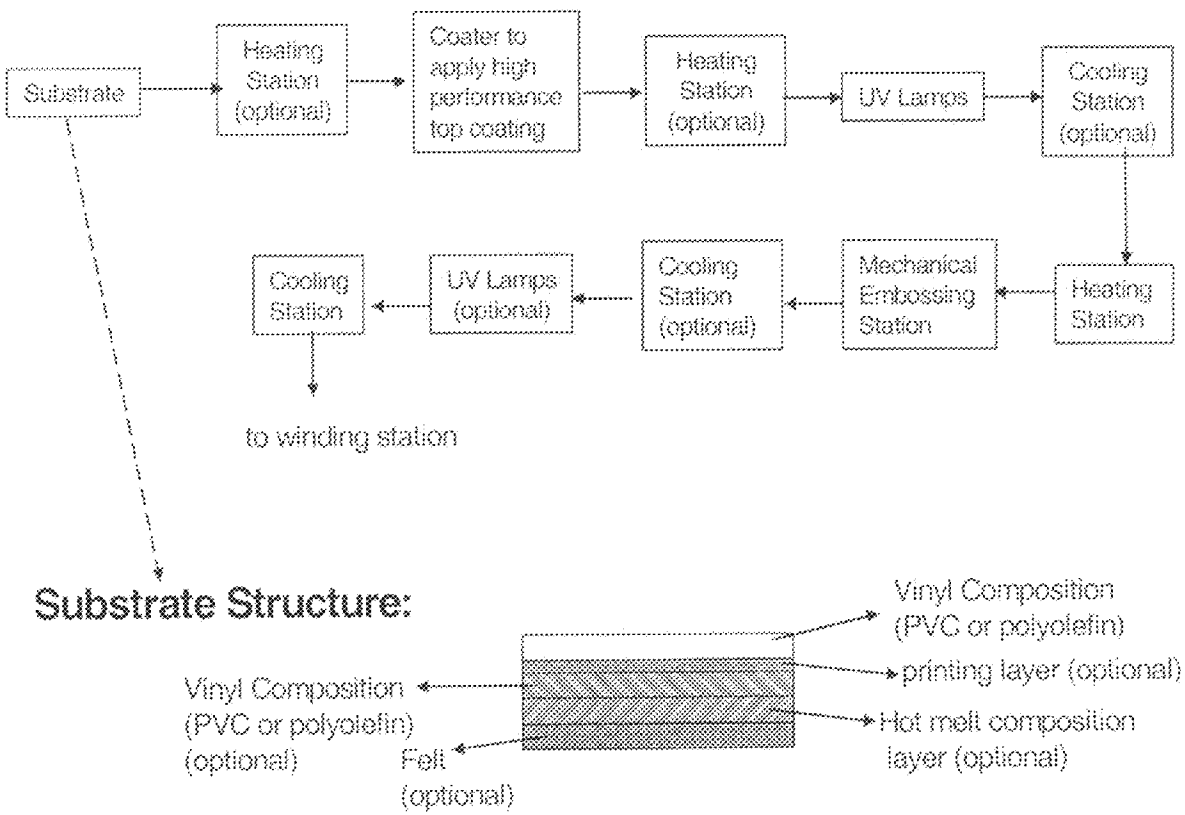
Figure 35:
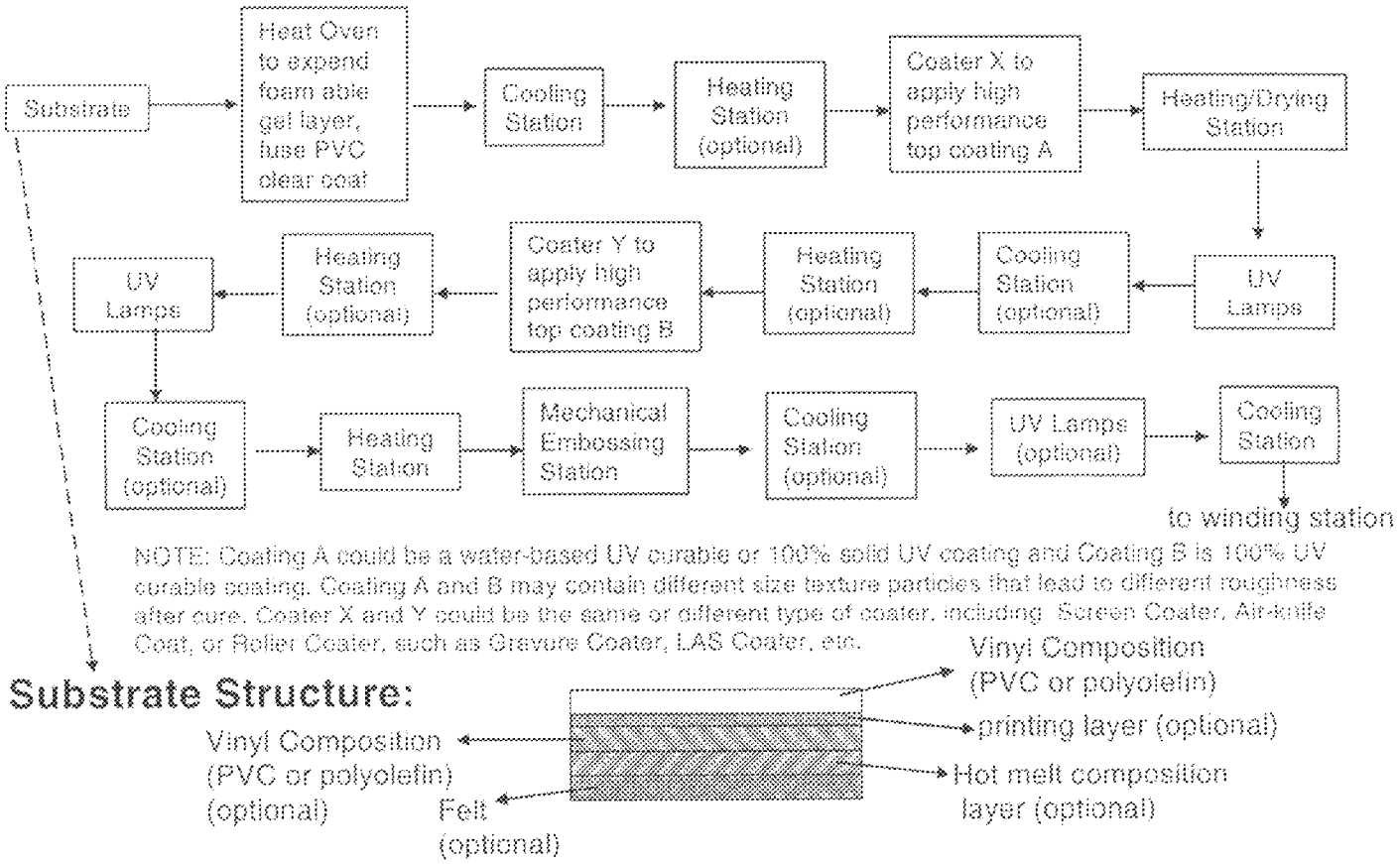

The FIG. 22 labeled "Variable Texture" shows profiles of samples of different roughness. The samples in order from roughest to smoothest is 052605 Air Dried 12 (RPc=47.89) to 042505 X-8G 26 (RPc=45.90) to 042505 X-8 10 (RPc=20.57) to 042505 X-10 1 (RPc=13.23).

Various methods and substrates of the present invention are shown in the Process Flow Charts Method 1 to Method 12 (FIGS. 23 to 35). The methods are not limited to substantially the same gloss level between the different textured areas. The substrates can also include wood and laminates. Further, the substrate could be a film, which after being mechanically embossed is laminated or adhered to another substrate, or the film can be simultaneously mechanically embossed and laminated to another substrate.

The partial curing of the high performance coating can be accomplished by heating the coating or subjecting the coating to radiation curing for a limited amount of time. The radiation curing can be UV curing or e-beam curing. The thickness of the high performance coating is preferably about 5μ to about 75μ, more preferably about 12μ to about 50μ. After the high performance coating is mechanically embossed, it can be cured further, for example, by subjecting it to additional radiation.

I claim:

1. A method of making a floor covering having variable tactile surface characteristics comprising:

a) forming a high performance coating comprising texture particles on a substrate, b) then at least partially curing the high performance coating, c) then while controlling the temperature of the high performance coating below a melting point or a softening point of the texture particles and above temperature and pressure conditions at which the texture particles deform under an applied mechanical embossing pressure, mechanically embossing the high performance coating with a mechanical embossing tool wherein (i) a first portion of the high performance coating is subjected to a first average pressure and a second portion of the high performance coating is subjected to a second average pressure, or (ii) controlling the temperature of a first portion of the high performance coating at a first temperature and controlling the temperature of a second portion of the high performance coating wherein the first portion of the high performance coating and the second portion of the high performance coating are subjected to substantially the same average pressure, or (iii) controlling the temperature of a first portion of the high performance coating at a first temperature and controlling the temperature of a second portion of the high performance coating wherein the first portion of the high performance coating is subjected to a first average pressure and the second portion of the high performance coating is subjected to a second different average pressure, and d) then cooling the mechanically embossed high performance coating, whereby the tactile surface characteristic of the first portion is different than the tactile surface characteristic of the second portion by at least an average RPc of 4.

2. The method of claim 1, wherein the temperature of the high performance coating during the mechanical embossing step is between approximately 10° F. and approximately 400° F. below the melting point or the softening point if the melting point or the softening point is no greater than 575° F., and between approximately 250° F. and approximately 450° F. below the melting point or the softening point if the melting point or the softening point is greater than 575° F.

3. The method of claim 1, wherein a difference in the 60° gloss level across the floor covering is no greater than about 5.

4. The method of claim 1, wherein the at least partial curing is the result of subjecting the high performance coating to ultra-violet radiation.

5. The method of claim 1, wherein the substrate is chemically embossed prior to mechanically embossing the high performance coating.

6. The method of claim 5, wherein the substrate is chemically embossed after the high performance coating is applied to the substrate.

7. The method of claim 1, wherein the texture particles are organic polymer particles.

8. The method of claim 7, wherein the texture particles are selected from the group consisting of nylon particles, man-made wax particles, natural wax particles, polyolefin particles, Teflon particles, polyetheretherketone particles, ethylene and chlorotrifluoroethylene copolymer particles, polyester particles, urea-formaldehyde polymer particles, polyacrylate particles, polycarbonate particles, polyvinylchloride particles, polyimide particles and combinations thereof.

9. The method of claim 1, wherein the difference in the first average pressure and the second average pressure results from (i) one or more peaks on the mechanical embossing tool corresponding to the first portion having a greater height than the one or more peaks on the mechanical embossing tool corresponding to the second portion, (ii) the one or more peaks on the mechanical embossing tool corresponding to the first portion and the one or more peaks on the mechanical embossing tool corresponding to the second portion having substantially the same height, but the widths of the one or more peaks being different, or (iii) the substrate being chemically embossed.

10. A method of making a floor covering having a tactile surface characteristic of a first predetermined average RPc value comprising;

a) forming a high performance coating comprising texture particles on a substrate, b) then at least partially curing the high performance coating, c) then while controlling the temperature of the high performance coating below a melting point or a softening point of the texture particles and above temperature and pressure conditions at which the texture particles deform under an applied mechanical embossing pressure, mechanically embossing the high performance coating at a predetermined desired average pressure, and d) then cooling the mechanically embossed high performance coating, whereby the tactile surface characteristic can be varied to a second predetermined average RPc value by varying the temperature and/or pressure of the high performance coating during mechanical embossing to a different predetermined temperature and/or pressure.

11. The method of claim 10, wherein the temperature of the high performance coating during the mechanical embossing step is between approximately 10° F. and approximately 400° F. below the melting point or the softening point if the melting point or the softening point is no greater than 575° F., and between approximately 250° F. and approximately 450° F. below the melting point or the softening point if the melting point or the softening point is greater than 575° F.

12. The method of claim 10, wherein the texture particles are selected from the group consisting of nylon particles, man-made wax particles, natural wax particles, polyolefin particles, Teflon particles, polyetheretherketone particles, ethylene and chlorotrifluoroethylene copolymer particles, polyester particles, urea-formaldehyde polymer particles, polyacrylate particles, polycarbonate particles, polyvinylchloride particles, polyimide particles and combinations thereof.

* * * * *